US010213665B1

(12) United States Patent
Day et al.

(10) Patent No.: US 10,213,665 B1
(45) Date of Patent: Feb. 26, 2019

(54) GOLF CLUB HEAD WITH ADJUSTABLE WEIGHT

(71) Applicant: Cobra Golf Incorporated, Carlsbad, CA (US)

(72) Inventors: Cameron J. Day, Vista, CA (US); Andrew Curtis, La Jolla, CA (US); Bryce Hobbs, Carlsbad, CA (US); Douglas E. Roberts, Carlsbad, CA (US); Sean Tang, Irvine, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 103 days.

(21) Appl. No.: 15/269,162

(22) Filed: Sep. 19, 2016

Related U.S. Application Data

(63) Continuation-in-part of application No. 14/934,730, filed on Nov. 6, 2015.

(60) Provisional application No. 62/191,710, filed on Jul. 13, 2015.

(51) Int. Cl.
*A63B 53/06* (2015.01)
*A63B 53/04* (2015.01)

(52) U.S. Cl.
CPC ..... *A63B 53/06* (2013.01); *A63B 53/0466* (2013.01); *A63B 2053/0433* (2013.01); *A63B 2053/0491* (2013.01)

(58) Field of Classification Search
CPC ..... A63B 2053/0491; A63B 53/06
USPC ..... 473/334, 335, 336, 337, 338
See application file for complete search history.

(56) References Cited

U.S. PATENT DOCUMENTS 1,518,316 A * 12/1924 Ellingham ..... A63B 53/0487 473/337
2,163,091 A * 6/1939 Held ..... A63B 53/08 473/338
2,257,575 A 9/1941 Reach
3,466,047 A 9/1969 Rodia et al.
3,692,306 A * 9/1972 Glover ..... A63B 53/02 473/306
3,743,297 A * 7/1973 Dennis ..... A63B 15/00 473/242
4,043,563 A 8/1977 Churchward
4,052,075 A * 10/1977 Daly ..... A63B 53/08 473/338
4,085,934 A 4/1978 Churchward
5,050,879 A * 9/1991 Sun ..... A63B 53/04 473/338
5,154,424 A 10/1992 Lo
5,273,283 A 12/1993 Bowland
5,316,305 A * 5/1994 McCabe ..... A63B 53/04 473/332
5,385,348 A * 1/1995 Wargo ..... A63B 53/08 473/291

(Continued)

*Primary Examiner* — William Pierce
(74) *Attorney, Agent, or Firm* — Brown Rudnick LLP; Mark S. Leonardo

(57) ABSTRACT

The invention provides a golf club head with a lid or cover enclosing a recess such as a channel for an adjustable weight. A golf club head can include a multi-position weight track or other channel or concavity to house a feature such as an adjustable weight mechanism. The club head has a lid that covers the channel, which—when closed—provides an outer surface of the golf club head that does not collect dirt or make whistling sounds when used and thus removes distractions and maintains the club head's intended weight distribution.

8 Claims, 39 Drawing Sheets

(56) References Cited

U.S. PATENT DOCUMENTS 6,089,994 A 7/2000 Sun
6,227,032 B1 5/2001 Sell et al.
6,277,032 B1 * 8/2001 Smith ..... A63B 53/04 473/336
6,364,788 B1 4/2002 Helmstetter et al.
6,638,183 B2 * 10/2003 Takeda ..... A63B 53/047 473/335
6,860,818 B2 3/2005 Mahaffey et al.
7,121,956 B2 * 10/2006 Lo ..... A63B 53/04 473/335
7,309,295 B2 12/2007 Solari
7,530,903 B2 5/2009 Imamoto et al.
7,549,933 B2 6/2009 Kumamoto
7,566,276 B2 * 7/2009 Billings ..... A63B 53/0487 473/251
7,749,101 B2 7/2010 Imamoto et al.
8,172,699 B2 5/2012 Nakamura
8,262,495 B2 * 9/2012 Stites ..... A63B 53/047 473/226
8,337,325 B2 * 12/2012 Boyd ..... A63B 53/047 473/332
8,430,763 B2 * 4/2013 Beach ..... A63B 53/06 473/307
8,506,421 B2 8/2013 Stites et al.
8,888,607 B2 * 11/2014 Harbert ..... A63B 53/04 473/307
9,259,627 B1 2/2016 Myers et al.
9,409,073 B2 8/2016 Boyd et al.
9,914,028 B1 * 3/2018 Cleghorn ..... A63B 53/0466
2006/0178228 A1 8/2006 DiMarco
2007/0298904 A1 * 12/2007 Dworzan ..... A63B 53/02 473/340
2008/0070721 A1 3/2008 Chen et al.
2008/0261715 A1 10/2008 Carter
2009/0270199 A1 10/2009 Chen
2012/0083360 A1 * 4/2012 Boyd ..... A63B 53/0466 473/337
2013/0090185 A1 4/2013 Boyd et al.
2013/0324299 A1 12/2013 Clausen et al.
2015/0375066 A1 12/2015 Mizutani
2016/0158598 A1 * 6/2016 Dolezel ..... A63B 53/04 473/223

* cited by examiner

GOLF CLUB HEAD WITH ADJUSTABLE WEIGHT

CROSS-REFERENCE TO RELATED APPLICATION

This application is a continuation-in-part of U.S. application Ser. No. 14/934,730, filed Nov. 6, 2015, which application claims the benefit of U.S. Provisional Application No. 62/191,710, filed Jul. 13, 2015, the contents of which are incorporated by reference.

TECHNICAL FIELD

The invention relates to golf clubs.

BACKGROUND

For many people, the serenity of golf is a valuable part of the experience. In contrast to rough days at work or the noise and bother of traffic, golf is a great walk enriched by nature's green backdrop, the company of friends, and quiet time outdoors. The clothing and equipment used in golf can be designed to complement the experience. Unfortunately, sometimes new technical innovations have negative impacts on the experience.

Golf club designers seek to offer adjustable golf clubs. However, these new features may interfere with the functioning of golf clubs. Large openings in a golf club can trap dirt and grass, which upsets the weight distribution of the club, and contributes to off-target shots. Also, openings in a club head surface impact the acoustic resonances of a club, even though many golfers rely on the sound that the club head makes for important feedback information about their swing while playing. Moreover, slots and holes in club heads can make unwanted whistling noises that are distracting and interrupt a player's concentration.

SUMMARY

The invention provides a golf club head with a lid or cover enclosing a recess such as a channel for an adjustable weight. A golf club head can include a multi-position weight track or other channel or concavity to house a feature such as an adjustable weight mechanism. The club head has a lid that covers the channel, which—when closed—provides an outer surface of the golf club head that does not collect dirt or make whistling sounds when used and thus removes distractions and maintains the club head's intended weight distribution. Additionally, when a weight track or other channel is on a sole of a club head, adding a lid over the channel tends to concentrate mass in a distribution that many golfers find favorable. That is, the mass is low, when the club head is at address, and tends to lower a center of gravity of the club head. Also, a lid can add structural rigidity that allows the inner components of a channel or weight track to be made out of lighter weight material than would be permissible in a club head without a lid, in which the channel walls and floor would have to provide the structural rigidity to accommodate the opening in the sole. In addition, when the weighting mechanism is inside the hollow body, it mitigates the negative impact of water, dirt and ground contact.

Since the channel walls and floor can be made of lighter weight material by including a lid or cover, discretionary mass is "freed up" and a club head designer can position that mass elsewhere in the club head to optimize mass distribution or perform structural functions of the club head. For example, the discretionary mass can be positioned as ribs or struts to further increase the rigidity of the club head structure surrounding the internal weight or channel. Thus, since including a lid frees up mass allowing a designer to improve mass distribution or structure, and avoids undesirable noises and adverse effects arising from dirt and turf collecting in channels, a club head of the invention provides a better playing experience. Since the golfer is not distracted or frustrated by noises and unpredictable playing characteristics, a club head of the invention allows the golfer to play better, get a better score, and realize greater value from the golfing experience.

Aspects of the invention provide a golf club head that includes a ball-striking face at a front portion of the club head with a crown and a sole extending back from the ball striking face. The crown meets the sole at a heel side, a toe side, and an aft portion of the club head. The ball-striking face, the crown, and the sole define a hollow interior volume of the club head. A hosel extends up from the heel side of the front portion of the club head. The club head includes an opening through the club head; a removable panel enclosing the opening through the club head; at least one post on an inside surface within the hollow interior volume of the club head; and a first base disc removably attached to the post. Preferably the opening is on the sole of the golf club head. The inside surface with the post may be on the removable panel. Optionally the removable panel includes a second post on the inside surface.

The club head may further include a second disc removably attached to the second post. In some embodiments, the first base disc has a disc-shaped body; a first female-threaded bore through the body, complementary to a threaded surface on the post; a first mount-point extending up from an upper surface of the disc-shaped body; and a first external, male-threaded surface on the first mount-point. The club head may include a first top disc comprising a bore defining a first threaded inner surface complementary to the first external, male-threaded surface on the first base disc. A second base disc may include a disc-shaped body; a second internal, female-threaded bore complementary to the threaded surface on the post; a second mount-point extending up from an upper surface of the disc-shaped body; and a second external, male-threaded surface on the second-point. The golf club head may include a second top disc with a bore defining a second threaded inner surface complementary to the first external, male-threaded surface on the first base disc and the second base disc.

In some embodiments, at least a portion of the sole is provided by a club head body piece that includes the hosel and a ledge extending around an area of the crown, with the ledge defining an opening through a crown region of the club head body. A crown piece may be bonded to the ledge by an adhesive.

In certain embodiments, the club head body includes two wells configured to receive the first disc and the second disc when the removable panel is attached to the club head. Preferably, the removable panel includes a first screw held within the post via a clip ring and a second screw held within the second post by a second clip ring, wherein when the removable panel is attached to the club head, the screws are received by threaded bores in the wells. The first top disc has a first mass and the second top disc has a second mass which may be unlike the first mass.

In certain aspects, the invention provides a hollow, wood-type club head. The club head has a ball-striking face at a front portion of the club head with a crown and a sole extending back from the ball striking face. The crown meets the sole at a heel side, a toe side, and an aft portion of the club head. The ball-striking face, the crown, and the sole define a hollow interior volume of the club head. The club head includes a hosel extending up from the heel side of the front portion of the club head. The club head further includes a first disc port through the club head as well as a first disc seated in, and enclosing, the port. The club head may include a second disc port (e.g., with the first disc port and the second disc port are in the sole). Preferably, the first disc port comprises a threaded inward-facing, ring-shaped surface. The first disc is preferably a threaded disc screwed into, and covering, the port. The threaded disc has a main, disc-shaped body with a tool slot on one surface and a post on a second surface opposed to the surface. The post has a shape complementary to a shape of the tool slot. In certain embodiments, the threaded disc has a flange extending outwards radially past a threaded surface of the threaded disc. The flange provides a stopping point when the threaded disc is screwed into the port.

The club head may also include at least one stacking disc, which may have a main, disc-shaped body; a threaded surface around the body; and a second tool slot. The club head may include a second post, with the stacking disc mounted on the second surface of the threaded disc, with the post inserted into the second tool slot.

Preferably, the port has a diameter of at least about 1 cm. Where more than one disc port is included, preferably each of the first disc port and the second disc port have a threaded inward-facing, ring-shaped surface. In some embodiments, each of the first disc port and the second disc port have a diameter of at least about 1 cm. In certain embodiments, at least one of the first disc port and the second disc port has a diameter of about 2 cm. When the threaded disc is removed from the port, the port provides an opening into the hollow interior volume of the club head, the opening having an area of at least $\pi(0.5\text{ cm})^2$. The club head may further include a third disc port.

Optionally, the first disc port, the second disc port, and the third disc port are disposed across the sole in a heel-toe direction. The first disc may have a post and a slot on opposed surfaces, the post being complementary to the slot so that the first disc may be stacked with a second disc having a second slot shaped similarly to the slot.

The club head preferably includes at least a first stacking disc stacked on the first disc. The first stacking disc has a second disc-shaped body with a second slot and a second tool post, and a second threaded surface about the second disc-shaped body. The club head may further include a second stacking disc, e.g., stacked on the second disc. Preferably the first stacking disc and the second stacking disc are each configured to be stacked onto any of the other discs and retained there by a post-in-slot press-fit mechanism. (The second stacking disc stacked on the second disc may have a third disc-shaped body with a third slot and a third tool post, and a third threaded surface about the third disc-shaped body.) In certain embodiments, the first disc has a first mass and the second disc has a second mass unlike the first mass. Preferably the first stacking disc has a third mass and the second stacking disc has a fourth mass unlike the third mass. In some embodiments, the fourth mass and the third mass are both unlike the first mass and the second mass.

In certain embodiments, the first disc includes a device such as a battery; an accelerometer; an RFID tag; an antenna; a microchip; a tangible memory device; an input/output jack; and a piezoelectric sensor. Optionally, the club head may include ports of varying diameters and corresponding discs of varying diameters. Any of the discs may include a translucent or transparent material.

The club head may also include at least one capped well on a surface of the club head, wherein the capped well is threaded and further wherein the threaded disc and the stacking disc each independently may be screwed into the capped well. Preferably, the threaded disc has a first mass and the stacking disc has a second mass unlike the first mass.

In certain aspects, the invention provides a golf club head having a front portion defining a hosel extending upwards from a heel-side of a ball-striking face when the club head is at address and a crown portion and a sole portion extending back from the face and meeting to define a club head body. The club head has a recess into the club head body configured to house an adjustment member and an openable lid enclosing at least a portion of the recess. A fastening mechanism is included to hold the lid in a closed position when the golf club head is used in golf.

In certain embodiments, the recess defines a channel extending in a face-aft direction along the sole portion. When the lid is held in the closed position, a surface of the lid and an outer surface of the sole portion may define a substantially smooth, downward facing surface when the club head is at address, the surface having no gaps or openings greater than 5 mm across.

The adjustment member may include a repositionable weight. In some embodiments, the channel defines a plurality of positions that can each accommodate the repositionable weight. When the fastening mechanism is fastened, the lid may apply a clamping force to the repositionable weight to maintain the repositionable weight in one position (an inside surface of the lid may include a protruding portion that pushes into a corresponding recess of the repositionable weight when the lid is closed).

Any suitable fastening mechanism may be included; for example, a screw that extends through the lid and is received by a threaded portion of the golf club head; or, the fastening mechanism may use a quick-release mechanism, a hinge, a sliding mechanism, a twisting mechanism, a snap-fit mechanism, a magnet, or a tab/slot combination.

In a preferred embodiment, the lid is hinged. The lid may include a hinge at one edge and the fastening mechanism at a second edge opposed to the one edge. Preferably the recess defines a channel extending in a face-aft direction along the sole portion and the hinge is at one end of the channel. The lid, when closed, may provide a surface of a portion of the sole having an area of at least 10 $cm^2$—e.g., the surface of the portion of the sole provided by the lid may be at least 5 cm×2 cm.

Aspects of the invention provide a golf club head that includes a front portion defining a hosel extending upwards from a heel-side of a ball-striking face when the club head is at address, a crown portion and a sole portion extending back from the face and meeting to define a hollow club head body having an interior volume, and an aperture into the club head body providing access to the interior volume. The club head includes an openable lid enclosing at least a portion of the aperture and a fastening mechanism to hold the lid in a closed position when the golf club head is used in golf. Preferably, when the lid is held in the closed position, a surface of the lid and an outer surface of the sole portion define a substantially smooth, downward facing surface when the club head is at address, the surface having no gaps or openings greater than 5 mm across. The club head may include an adjustment mechanism such as an adjustable weight member within the interior volume.

In certain embodiments, the aperture defines an elongated opening extending in a face-aft direction along the sole portion and the hinge is at one end of the opening. The lid may have a hinge at one edge and the fastening mechanism at a second edge opposed to the one edge. In some embodiments, the lid, when closed, provides a surface of a portion of the sole having an area of at least 10 $cm^2$—for example, at least 5 cm×2 cm.

DETAILED DESCRIPTION

The invention provides a lid for an enclosure such as a channel, recess, or weight track in a golf club head. In certain embodiments, the invention provides a sole lid to address issues with the current sliding weight mechanisms of existing drivers. In preferred embodiments, the golf club heads shown herein are hollow, wood-type club heads. Wood type club heads include drivers, fairways, and hybrids. In much preferred embodiments, the club heads shown herein are drivers.

Figure 1:
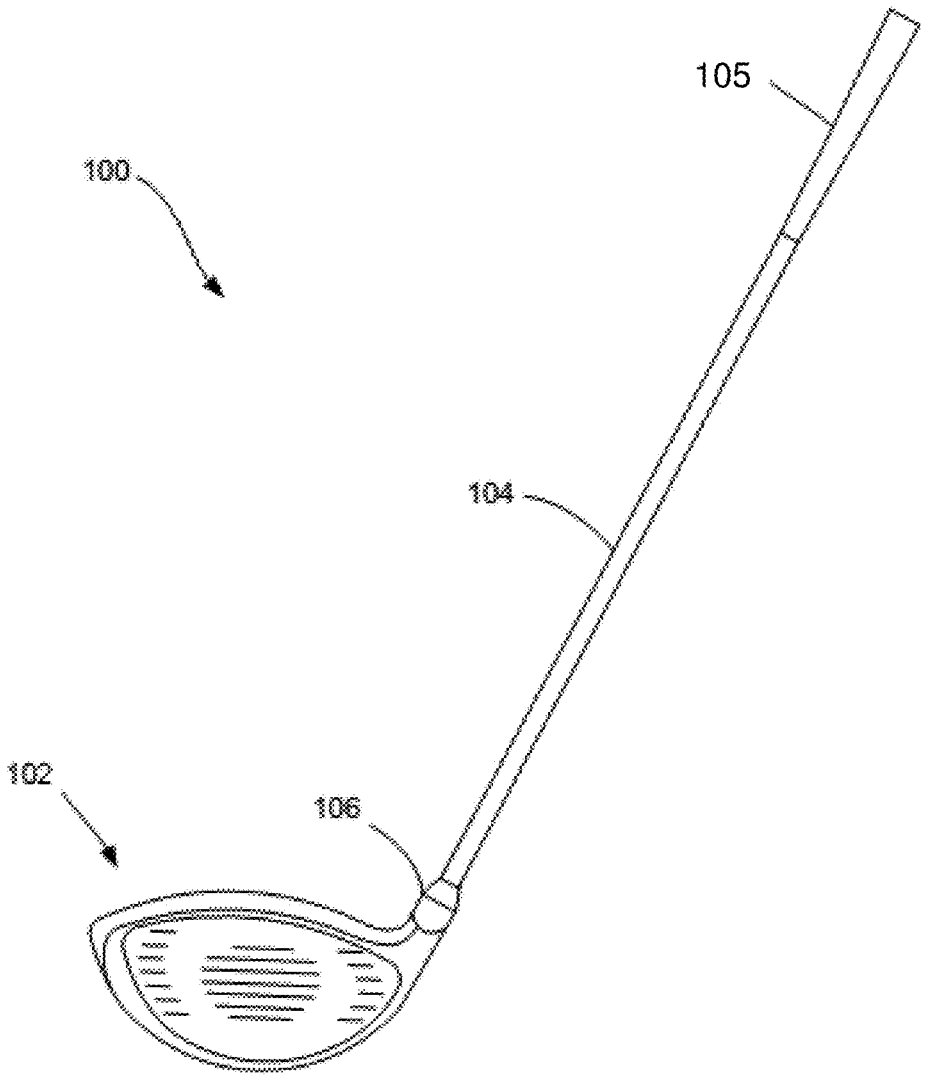
FIG. 1 shows a golf club that includes a golf club head of the invention.

FIG. 1 shows a golf club 100 that includes a golf club head 102 of the present invention. Golf club 100 may include a shaft 104 extending from a hosel 106 of club head 102 and terminating at grip 105. Golf club head 102 may be any suitable type of club head including, for example, a wood-type club head such as a driver, fairway wood, or a hybrid, an iron, a wedge, a putter, or any other suitable type. See, e.g., U.S. Pat. No. 7,309,295, incorporated by reference. In a preferred embodiment, club head 102 is a hollow, wood-type club head such as a driver, a fairway wood, or a hybrid. In a most preferred embodiment, club head 102 is a driver.

Figure 2:
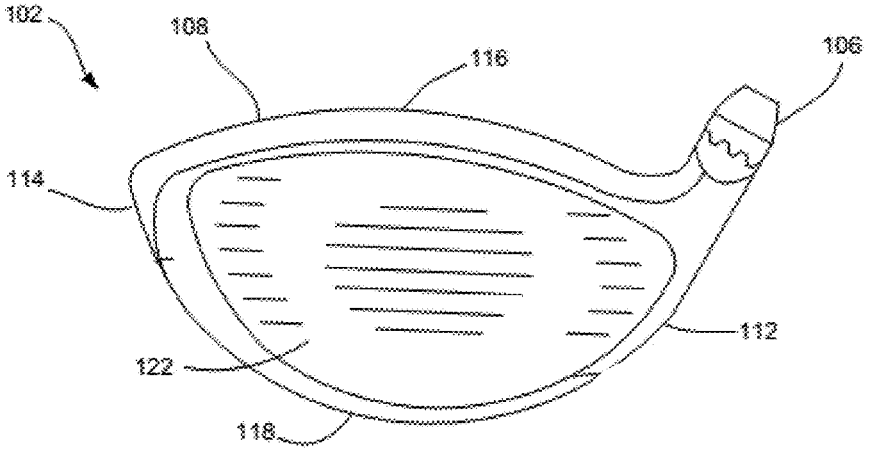
FIG. 2 illustrates a hollow, wood-type club head.

FIG. 2 illustrates a hollow, wood-type club head 102 according to preferred embodiments, shown here as a driver-type club head. Preferably hollow, wood-type club head 102 has a front portion 122 with a crown portion 116 and a sole portion 118 extending back form the crown to define the hollow club head body 108. The front portion 122 includes and provides a ball-striking face. A hosel 106 extends upwards from a heel-side 112 of the club head 102, opposed to the toe side 114. Preferably, crown 116, sole 118, heel side 112, and toe side 114 cooperate to define a hollow, enclosed club head body 108 that has an overall, or predominant, smooth aerodynamic surface. Parts or all of club head 102 may be made from metals, alloys, composites, or other materials. See e.g., U.S. Pub. 2008/0070721, incorporated by reference.

Figure 3:
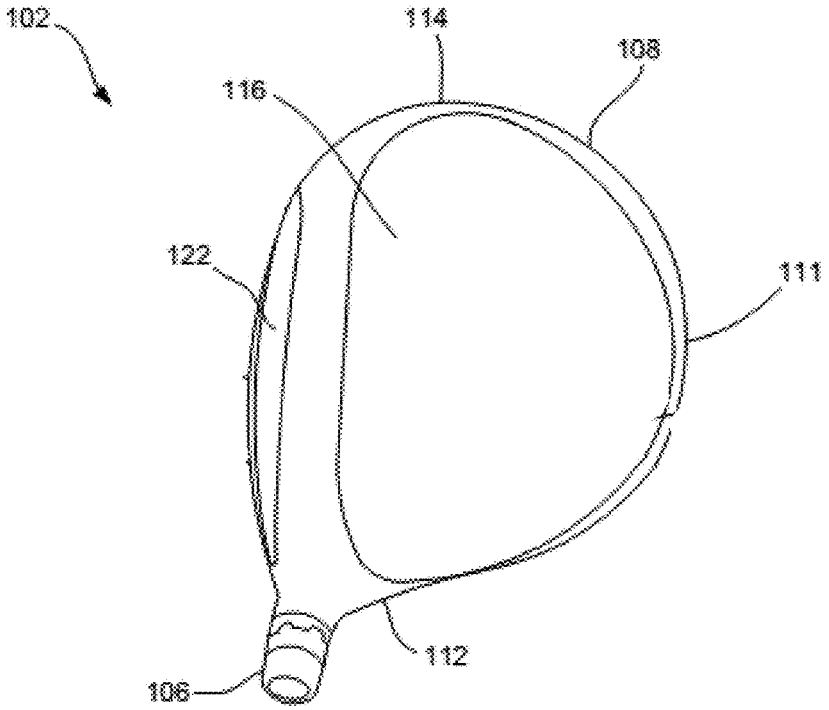
FIG. 3 gives a top view of the club head.

FIG. 3 gives a top view of the club head 102 according to preferred embodiments of the present invention. As discussed and shown in FIG. 3, club head 102 has a crown portion 116 extending back from front portion 122 and meeting the sole at the heel side 112 and toe side 114 as well as at an aft-portion 111.

Figure 4:
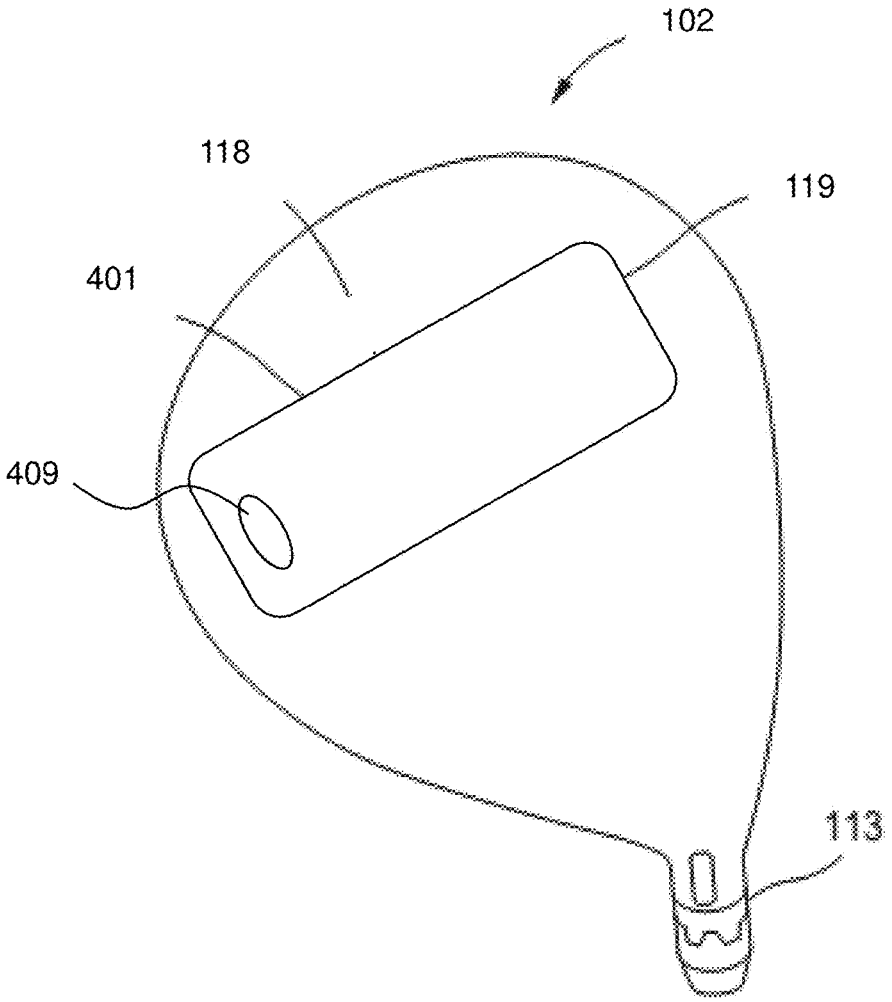
FIG. 4 gives a bottom view of the club head showing the sole.

FIG. 4 gives a bottom view of the club head 102 showing the sole portion 118. The overall smooth aerodynamic surface of the club head body 108 is provided in part by an openable lid 401 that encloses a channel or recess into the sole 118. The lid 401 includes a fastening mechanism 409 to hold the lid 401 in a closed position when the golf club head 102 is used in golf. Preferably, as shown in FIG. 4, when the lid is held in the closed position, a surface of the lid 401 and an outer surface of the sole portion 118 define a substantially smooth, downward facing surface when the club head is at address, the surface having no gaps or openings greater than 5 mm across.

Figure 5:
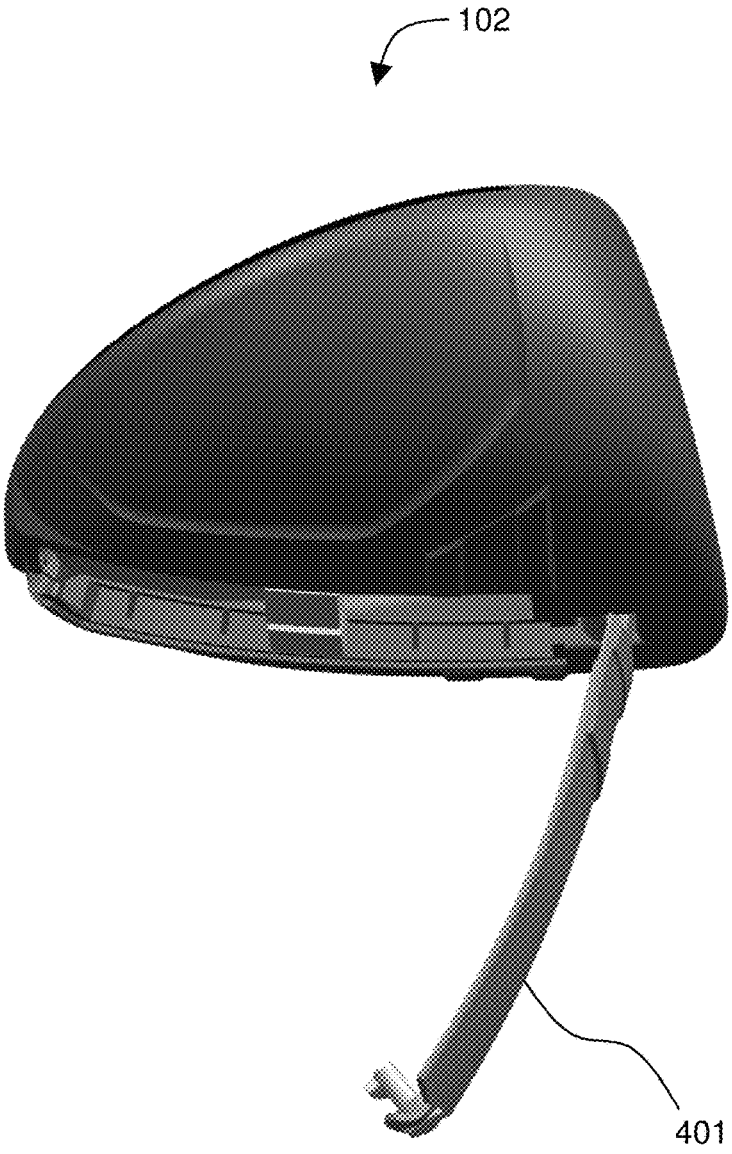
FIG. 5 shows a lid in an open configuration.

FIG. 5 shows lid 401 in an open configuration. In the depicted embodiment, the fastening mechanism has a tool interface accessible at an exterior surface of club head 102. The fastening mechanism may further include a threaded post that mates with a female threaded portion on the club head. I.e., the fastening mechanism 409 may include a screw that extends through the lid 401 and is received by a threaded portion of the golf club head 102. Alternatively or additionally, the fastening mechanism may include a twist-lock feature, or a quick-release mechanism, such as one or more protruding prongs inside of lid 401 that rotate when a tool is inserted into the tool interface and twisted. The prongs may rotate out to engage corresponding slots in the club head 102 to close the lid, and rotate in, under the lid 401, to disengage the slots to allow the lid to open. The prongs may have a ramped portion such that engaging them further applies more pressure to the slots to securely clamp the lid in a closed position as shown in FIG. 4.

As discussed above, the lid 401 encloses a channel or recess into the sole 118.

Figure 6:
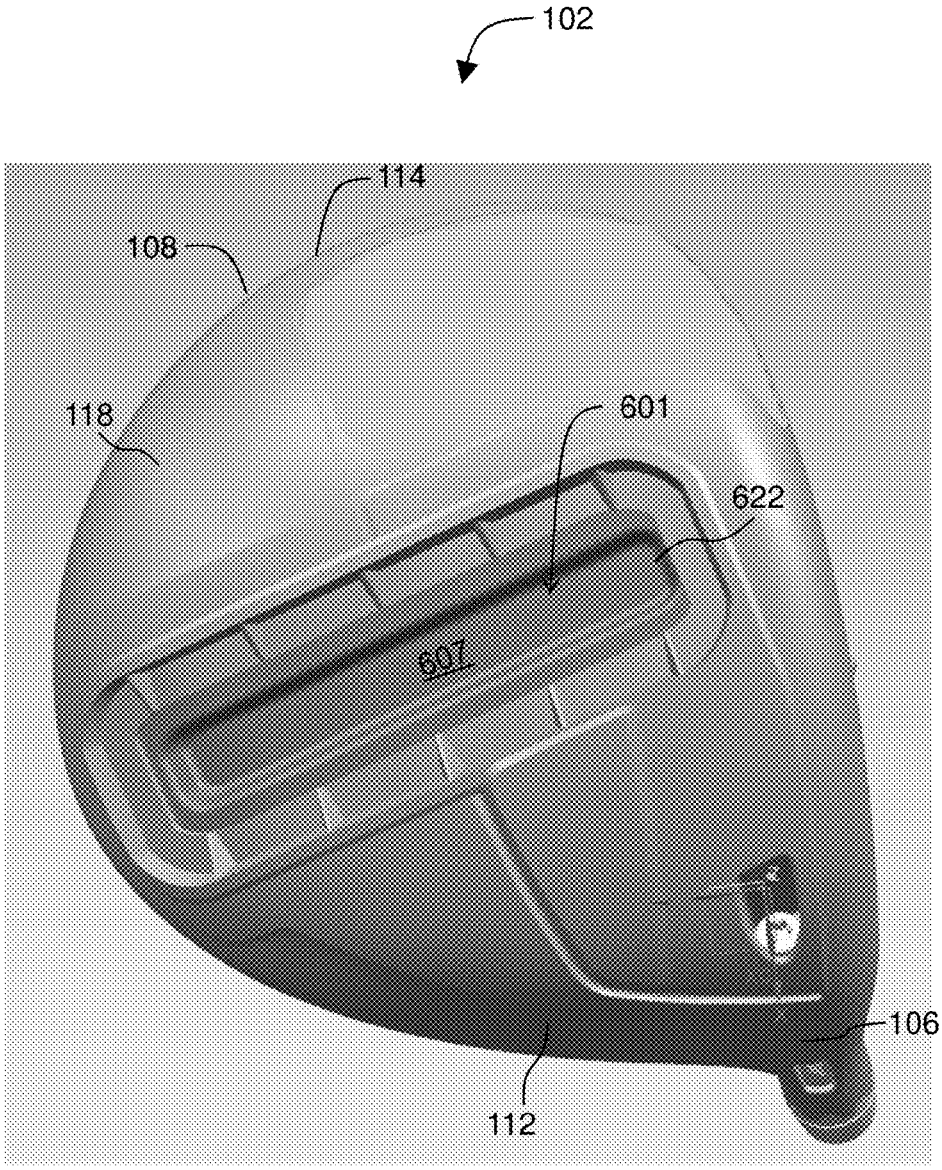
FIG. 6 illustrates a recess into the club head.

FIG. 6 illustrates a recess 601 into the club head body 108 configured to house an adjustment member. It can be seen the invention provides a golf club head 102 that includes a front portion 122 defining a hosel 106 extending upwards from a heel-side 112 of a ball-striking face when the club head 102 is at address and a sole portion 118 extending back from the front portion 122 and forming part of the club head body 108. The club head body 108 includes a recess 601 into the club head body configured to house an adjustment member. The recess 601 can be enclosed by the openable lid 401 (not shown in FIG. 6). As shown in FIG. 6, the recess 601 defines a channel 632 extending in a face-aft direction along the sole portion 118. It is also noted that the channel 632 may include channel walls or floor 607 that may include a material different than a material of the club head body 108 or surrounding sole portion 118.

Figure 7:
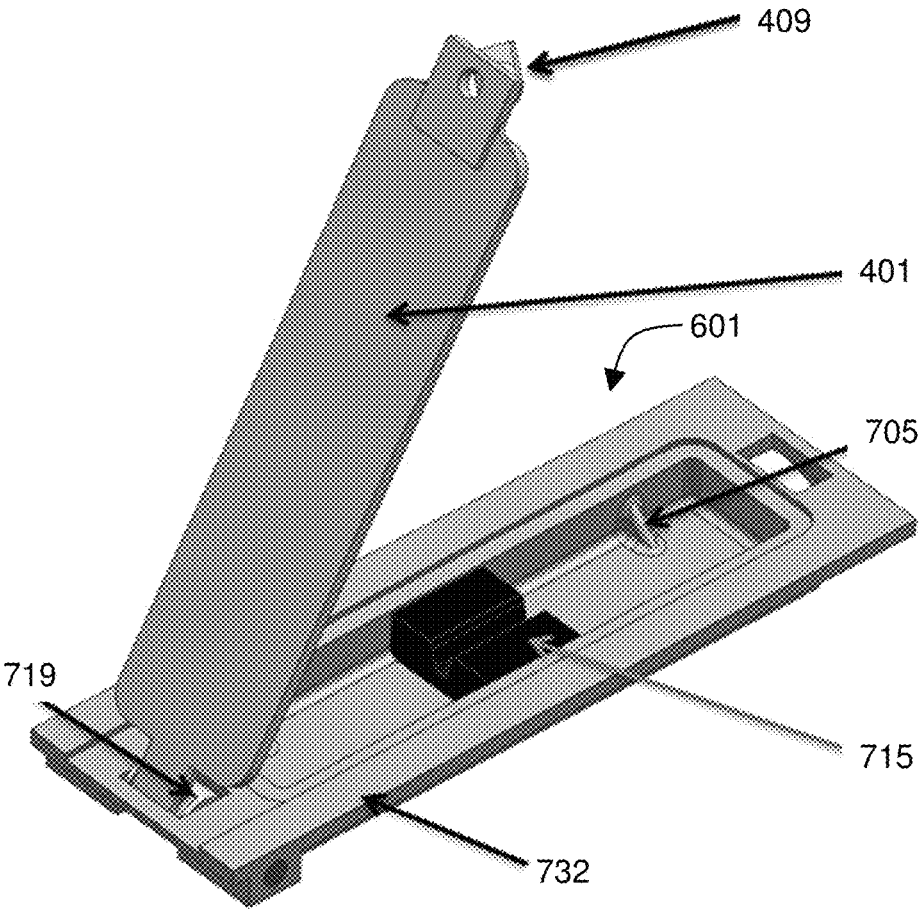
FIG. 7 illustrates a lid for enclosing the channel.

FIG. 7 illustrates lid 401 for enclosing the channel 632. The fastening mechanism 409 at one end may cooperate with a hinge 719 to create an openable lid 401. Here, the lid 401 includes a hinge 719 at one edge and the fastening mechanism 409 at a second edge opposed to the one edge. In the depicted embodiment, the channel 732 offers an adjustment mechanism for the club head 102. Here, the adjustment mechanism includes a repositionable weight 715. The repositionable weight may be set at one of a plurality of positions along the channel 732. In some embodiments, the plurality of positions are defined by one or more retaining features 705 disposed along channel 732. Thus it can be seen that channel 732 defines a plurality of positions that can each accommodate the repositionable weight.

In the depicted embodiment, when the fastening mechanism 409 is fastened, the lid 401 applies a clamping force to the repositionable weight 715 to maintain the repositionable weight 715 in one position within channel 732. An inside surface of the lid 401 may include a protruding portion that pushes into a corresponding recess 717 of the repositionable weight when the lid 401 is closed. Thus, FIG. 7 shows a hinged lid 401 that clamps down via a quarter turn screw system. The weight 715 is held into place via the clamping pressure from the lid 401 along with retaining features 705 within the cavity 632 of the club head 102.

Preferably the lid 401, when closed, provides a surface of a portion of the sole having an area of at least 10 $cm^2$. In this preferred embodiment of the invention, having a lid with an area of at least 10 $cm^2$ is critical since much smaller openings (e.g., weight ports) may not need a lid for the reasons given above—i.e., it is larger structures such as elongate weight channels that benefit most from the lid. In the depicted embodiments, the surface of the portion of the sole provided by the lid is at least 5 cm×2 cm.

Any suitable closure mechanism 409 may be used for lid 401. For example, the fastening mechanism 409 may include one or more selected from the group consisting of a hinge, a sliding mechanism, a twisting mechanism, a snap-fit mechanism, a magnet, and a tab/slot combination.

Some embodiments use front-to-back hinge as shown in FIG. 4. In alternative embodiments, the hinge may be along a long edge of the lid. Additionally or alternatively, the lid 401 may be closed through the use of screws (e.g., classic threads, quarter turn, etc.)

In a preferred embodiment and with continued reference to FIG. 7, the lid 401 encloses a channel 732 that accommodates a repositionable weight 715. The repositionable weight may be set at one of a plurality of positions along the channel 732. In the depicted embodiment, the weight 715 is retained in the channel and held in place through the clamping pressure of the lid 401. Other embodiments are within the scope if the invention and the weight 715 may be retained within the channel 732 by any suitable mechanism of action. For example, the weight 715 may be fixed within the channel via one or more screws, may be held in place by magnets, may be snapped into place by a snap-fit mechanism, or by a quarter-turn quick-release mechanism (akin to the mechanism by which golf cleats are held on).

While discussed above as a channel, it should be appreciated a club head can include one or more of the recess 601, and the recesses need not have a channel shape. For example, the club head could have a plurality of discrete recesses each configured to house a weight and in which all or each of the recesses is covered by a lid 401. A golf club head may include a recess 601 (for example, a channel) in which the walls and floor of the channel are entirely composed of titanium. Lighter weight structures could be used, however either such structure may be recessed into the club head. This may affect the center of gravity (CG) properties of the club head.

Figure 8:
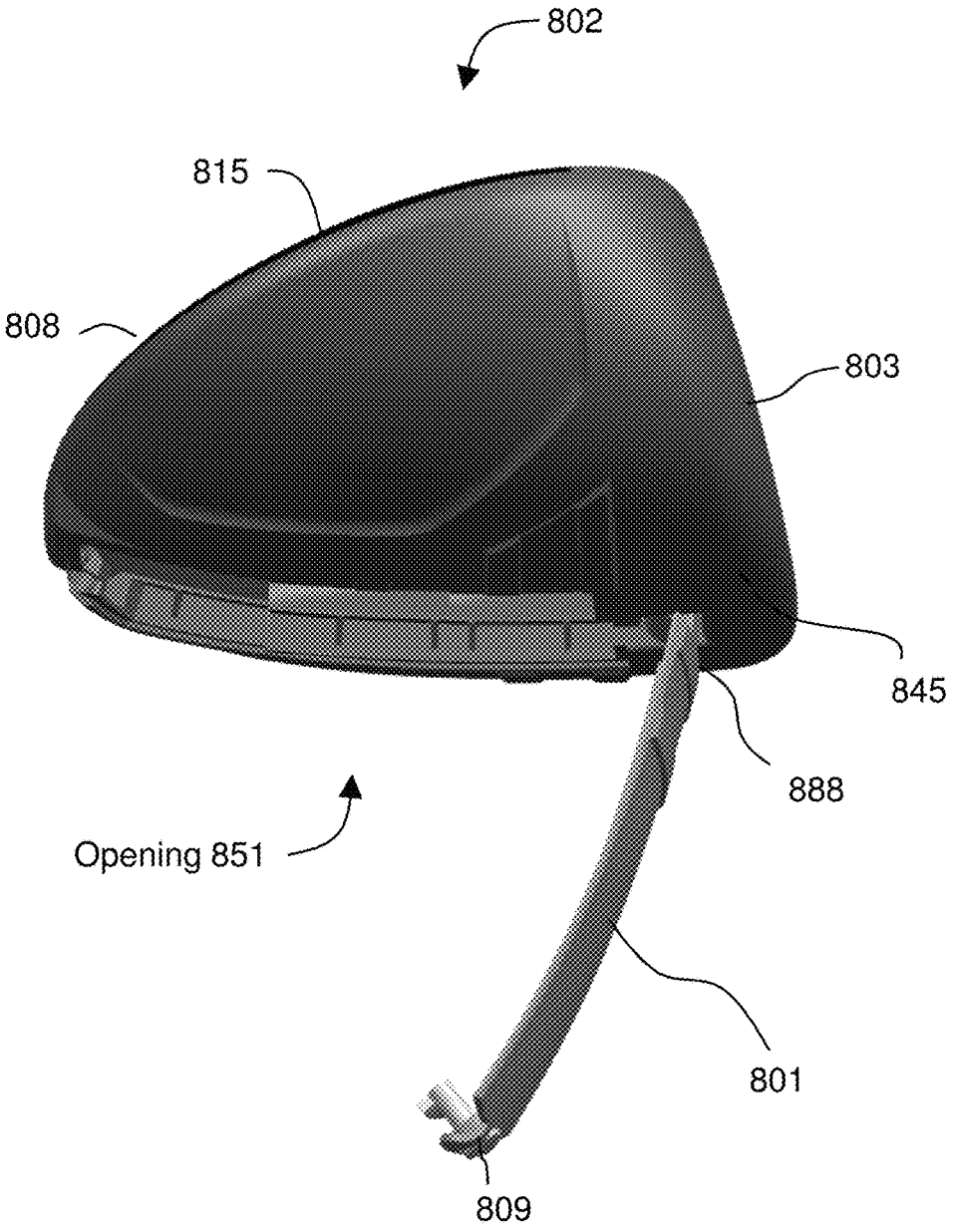
FIG. 8 shows a golf club head of the invention.

FIG. 8 depicts a golf club head 802 that includes a front portion 803 defining a hosel extending upwards from a heel-side of a ball-striking face when the club head is at address and a crown portion 815 and a sole portion 845 extending back from the face and meeting to define a hollow club head body 808 having an interior volume. The club head 802 has an aperture 851 into the club head body providing access to the interior volume as well as an openable lid 801 enclosing at least a portion of the aperture 851. The lid 801 includes a fastening mechanism 809 (e.g., a screw that extends through the lid and is received by a threaded portion of the golf club head, or a quick-release mechanism, a hinge, a sliding mechanism, a twisting mechanism, a snap-fit mechanism, a magnet, or a tab/slot combination) to hold the lid 801 in a closed position when the golf club head 802 is used in golf. Preferably, when the lid 801 is held in the closed position, a surface of the lid and an outer surface of the sole portion define a substantially smooth, downward facing surface when the club head is at address, the surface having no gaps or openings greater than 5 mm across.

The aperture 851 and lid 801 can be used to provide a club head 802 with an adjustment mechanism within the interior volume (e.g., an adjustment mechanism that uses an adjustable weight member). In the depicted embodiment, the lid 801 includes a hinge 888 at one edge and the fastening mechanism 809 at a second edge opposed to the one edge. The aperture 851 defines an elongated opening extending in a face-aft direction along the sole portion with the hinge at one end of the opening. The lid, when closed, provides a surface of a portion of the sole having an area of at least 10 $cm^2$. This is critical for an aperture 851 to provide access to an adjustment mechanism within the interior volume, as compared to, for example, a surface weight screw. The surface of the portion of the sole provided by the lid is at least 5 cm×2 cm.

The invention addresses problems with prior art club heads that have a channel which is open to the sole side of the club head. Those channels in prior art clubs resulted in debris collecting in the channel and also had a negative impact to the aerodynamics, resulting in reduced club head speed. Due to their inherent geometries, the channels can also produce a whistling sound during a golf swing. The fundamental frequency of the club heads are drastically decreased with the addition of the channel designs as well. This decrease in frequency severely affects the sound of the club head at impact. Designed internal ribs are needed to mitigate these sound issues, which eat up valuable discretionary weight. Solution: The sole lid 401 provides a solution to every one of the above-stated problems. Preferably the lid 401 covers a majority of the channel's opening. In some embodiments, the clamping force from the lid keeps the weight in place. In certain embodiments, the lid 401 covers the channel.

Any suitable construction can be used for a club head 102. See, e.g., U.S. Pat. No. 7,549,933; U.S. Pub. 2009/0270199; U.S. Pat. No. 7,749,101; and U.S. Pat. No. 7,530,903, the content of each of which are incorporated by reference.

The invention provides a golf club head that includes an openable lid and a fastening mechanism to hold the lid in a closed position when the golf club head is used in golf. The lid may be provided on any suitable club head type including a driver, a fairway, a hybrid, an iron, a wedge, or a putter. Preferably, the club head is a hollow, wood-type club head such as a driver, fairway, or hybrid. In a first preferred embodiment, the club head is a driver. In an alternative preferred embodiment, the club head is a fairway. It may be preferable for a driver to have a lid that is approximately 3×8 cm or a little bit larger to provide good access to the enclosure. For a fairway, it may be preferable to include a lid that is about 2×6 cm or a little bit larger.

Figure 9:
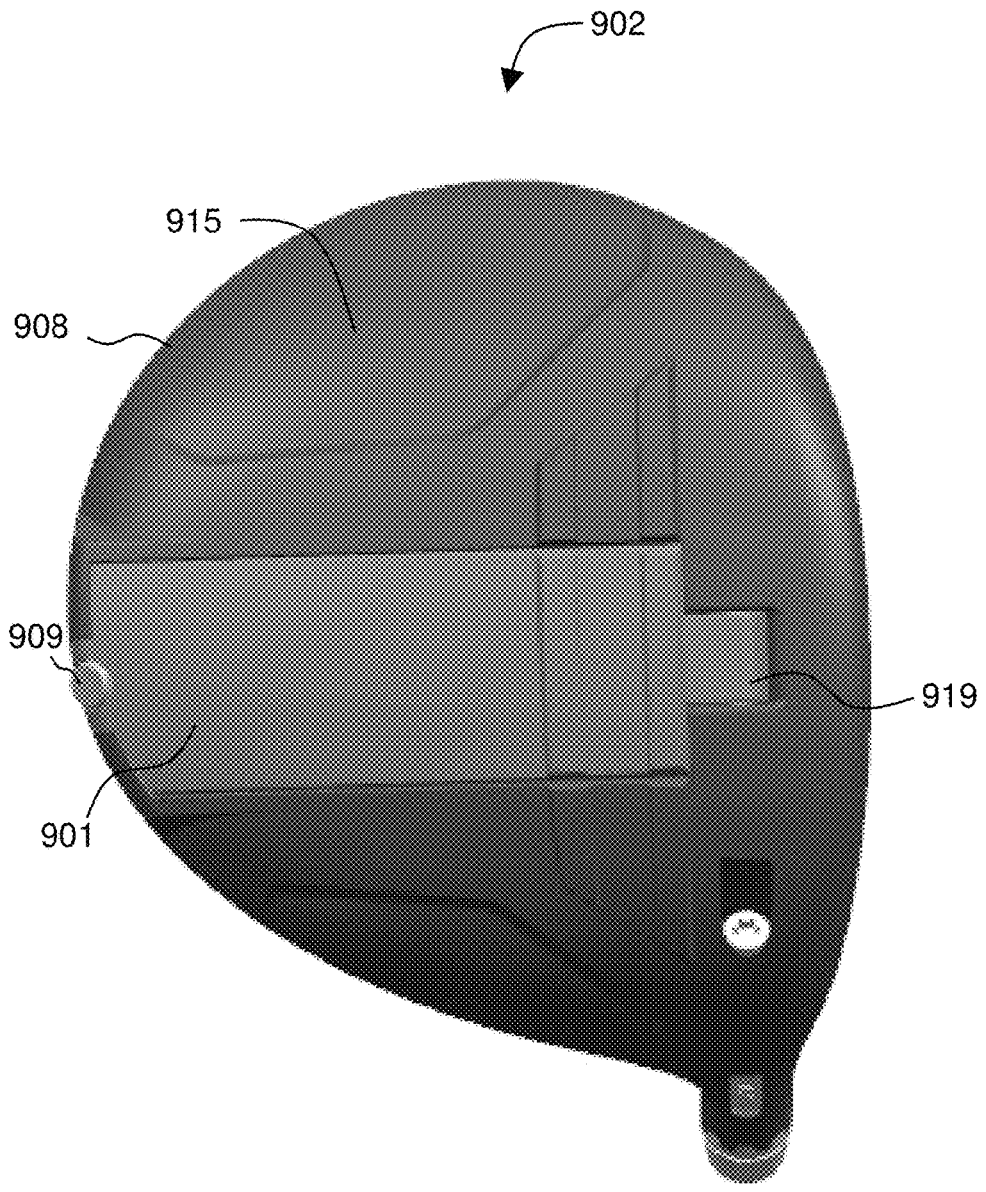
FIG. 9 illustrates a golf club head according to certain embodiments.

FIG. 9 illustrates a hollow, wood-type golf club head 902 according to certain embodiments. The golf club head 902 includes a front portion defining a hosel extending upwards from a heel-side of a ball-striking face when the club head is at address and a crown portion and a sole portion 915 extending back from the face and meeting to define a club head body 908. A recess extends into the club head body 908 configured to house an adjustment member and is covered by an openable lid 901 enclosing at least a portion of the recess. The depicted lid 901 is 85 mm×32 mm and has a hinge 919 at one and as well as a fastening mechanism 909 at the other end to hold the lid 901 in a closed position when the golf club head is used in golf.

Figure 10:
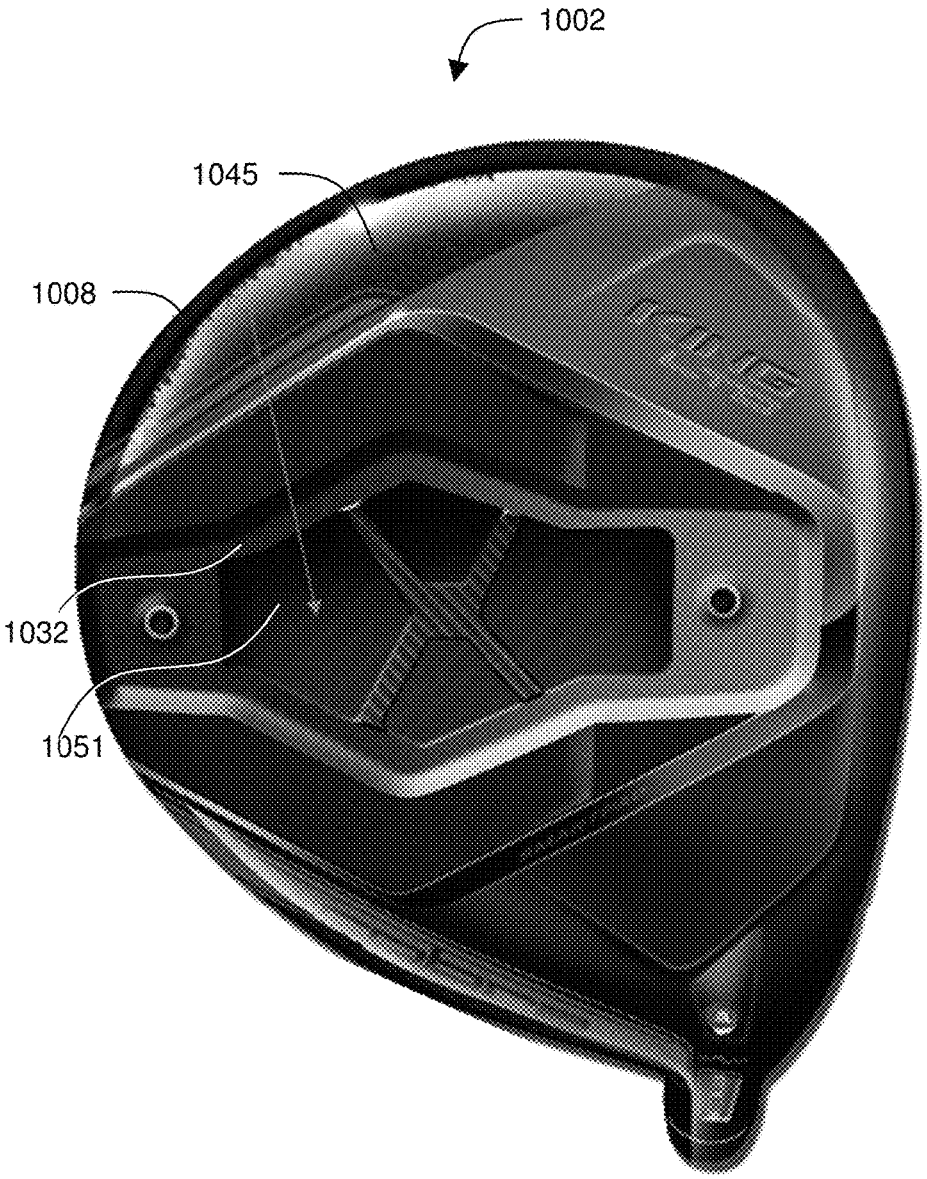
FIG. 10 shows a golf club head with a channel on a sole.

FIG. 10 shows a golf club head 1002 that includes a front portion defining a hosel extending upwards from a heel-side of a ball-striking face when the club head is at address and a crown portion and a sole portion 1045 extending back from the face and meeting to define a hollow club head body 1008 having an interior volume. The club head 1002 has a channel 1032 within the sole portion 1045. Within the channel 1032 is an aperture 1051 into the club head body providing access to the interior volume. A lid may be provided to enclose the channel 1032 and the aperture 1051 and to provide a substantially smooth continuation of the sole portion 1045.

Figure 11:
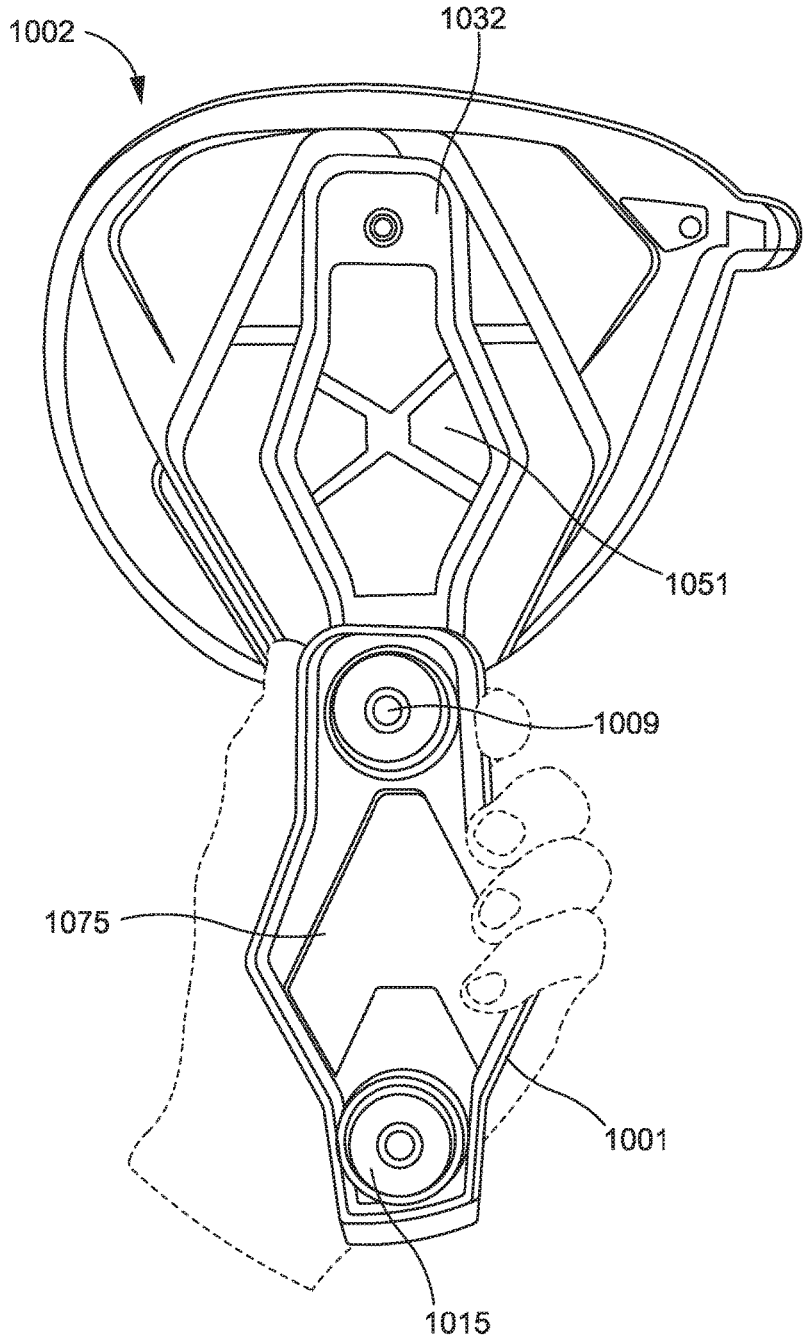
FIG. 11 shows a lid to enclose the channel on the sole of club head.

FIG. 11 shows a lid 1001 to enclose the channel 1032 and the aperture 1051 on the sole of club head 1002. The lid 1001 includes a fastening mechanism 1009 (e.g., a screw that extends through the lid and is received by a threaded portion of the golf club head, or a quick-release mechanism, a hinge, a sliding mechanism, a twisting mechanism, a snap-fit mechanism, a magnet, or a tab/slot combination) to hold the lid 1001 in a closed position when the golf club head 1002 is used in golf. Preferably, when the lid 1001 is held in the closed position, a surface of the lid and an outer surface of the sole portion define a substantially smooth, downward facing surface when the club head is at address, the surface having no gaps or openings greater than 5 mm across.

The aperture 1051 and lid 1001 may be used to provide a club head 1002 with an adjustment mechanism within the interior volume (e.g., an adjustment mechanism that uses an adjustable weight member). In the depicted embodiment, the lid 1001 is part of a mechanism for holding one or more repositionable weight members 1015 into desired positions. The aperture 1051 defines one or more opening through the sole. The use of a lid 1001 with two or more mount points (e.g., fastening mechanisms 1009) to enclose the channel 1032 adds rigidity relative to a channel that is not enclosed. Due to the added rigidity, it may be permissible to include the aperture 1051. This combination—a lid covering a channel in the sole and an aperture through that channel—locates mass on the club head in a distribution that will be beneficial to many players.

Figure 12:
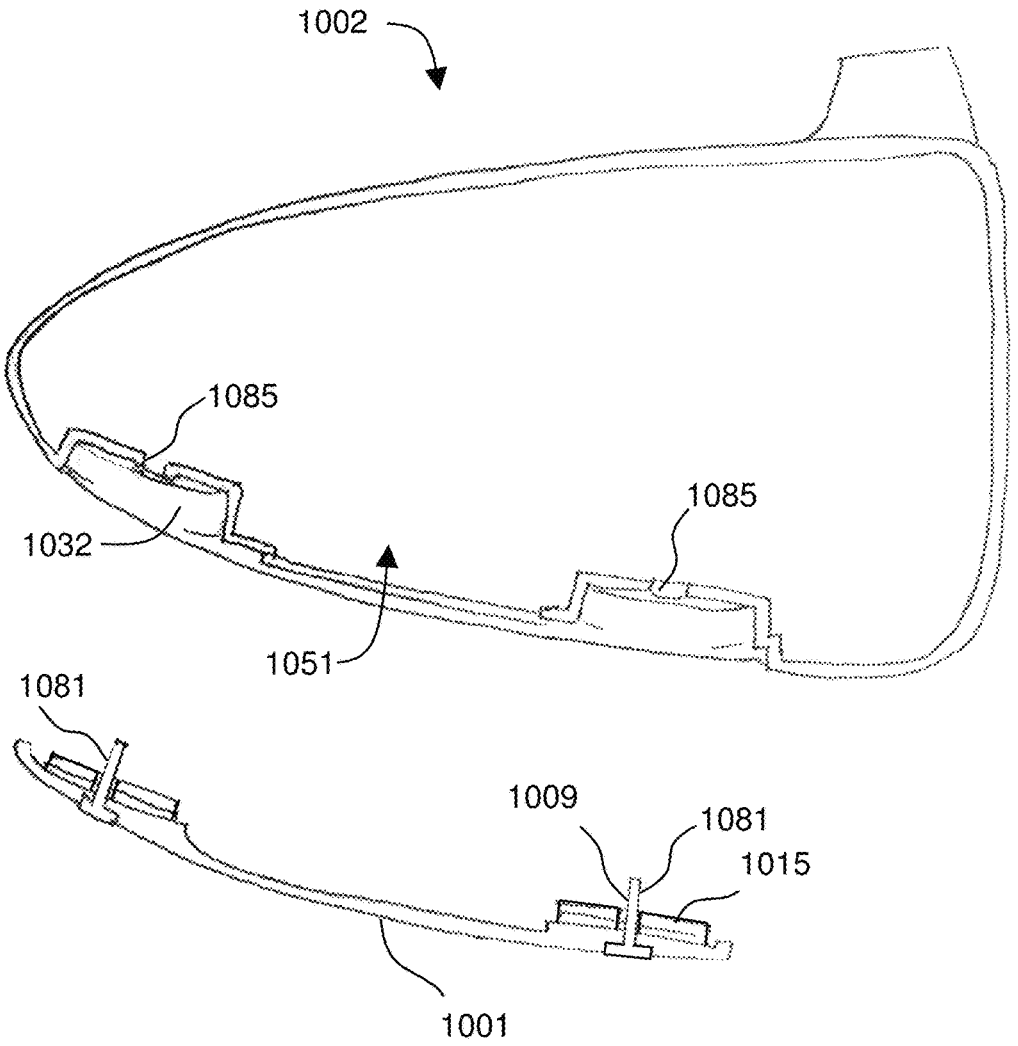
FIG. 12 shows a cutaway view of the club head.

FIG. 12 shows a cutaway view of the club head 1002. In the depicted embodiment, the lid 1001 is fastened to the club head body 1008 by a fastening mechanism 1009 that includes two or more screws 1081 having threaded posts that screw into threaded bores 1085 in the based on the channel 1032. It can be seen from FIG. 12 that fastening the lid 1001 in place by screwing the screws 1081 into the threaded bores 1085 will also fix the repositionable weight members 1015 in place within the club head 1002. The lid, when closed, provides a surface of a portion of the sole preferably having an area of at least 10 $cm^2$. This is useful for the aperture 1051 to provide a view into the interior volume, which allows functional information to be revealed through the sole such as the current placement of the repositionable weights and a printed guide (e.g., on an inside surface of the crown of club head 1002) that explains an effect of the weight positioning on club head performance. To serve this benefit, the lid 1001 may be provided with a transparent window 1075, such as acrylic, polycarbonate, glass, or crystal. The lid 1001 may be made from any suitable material and preferably includes a metal such as cast, forged, milled, or stamped stainless steel.

As shown in FIG. 12, the lid 1001 is dimensioned to fit within, and enclose, the channel 1032. The threaded bores 1085 are positioned to receive the screws 1081. Attaching the lid 1001 to the club head body 1008 holds repositionable weights 1015 in place. In a preferred embodiment, the club head 1002 will be provided with a plurality of (e.g., 4) repositionable weights 1015 of a variety of masses. Preferably, they are all the same dimensions and achieve different masses by having different overall densities. For example, one or more of the weights 1015 may be all aluminum while another may be an aluminum shell with a tungsten insert. Thus the repositionable weights 1015 preferably include at least a first low-mass weight and a second high-mass weight.

As shown in FIG. 11, the lid 1001 is shaped as a diamond-rectangle hybrid with a wide part in the middle to allow the window 1075 to be at least a few (e.g., 3) cm wide at the widest point and also at least 3 cm long in overall length, although other shapes and dimensions are within the scope of embodiments of the invention.

With reference to FIGS. 10-12, in certain aspects, the invention provides a golf club head comprising a front portion defining a hosel extending upwards from a heel-side of a ball-striking face when the club head is at address and a crown portion and a sole portion extending back from the face and meeting to define a hollow club head body having an interior volume. The club head has a channel within the sole portion. The channel may extend in a heel-toe direction and be at least 2 cm wide and at least 6 cm long. A lid may enclose the channel and provide a substantially smooth continuation of the sole portion. The club head includes a fastening mechanism to hold the lid 1001 in a closed position when the golf club head 1002 is used in golf. Suitable fastening mechanisms may include one or more of a screw that extends through the lid and is received by a threaded portion of the golf club head, a quick-release mechanism, a hinge, a sliding mechanism, a twisting mechanism, a snap-fit mechanism, a magnet, or a tab/slot combination. A preferred fastening mechanism will include at least one screw that extends through the lid to a female-threaded portion of the club head working in conjunction with either another screw or a hinge. Preferably, when the lid is held in the closed position, a surface of the lid and an outer surface of the sole portion define a substantially smooth, downward facing surface when the club head is at address, the surface having no gaps or openings greater than 5 mm across. The "base" of the channel may include an aperture into the club head body providing access to the interior volume so that, when the lid is not attached, a golfer may access the interior volume. The club head preferably includes an adjustment mechanism. The adjustment mechanism may include repositionable weight members. Preferably, the lid is part of a mechanism for holding one or more repositionable weight members into desired positions (e.g., via a fastening mechanism such as a screw, which may extend through one or more of the repositionable weight members, grab into the club head, and exhibit a clamping force on the one or more repositionable weight members.

In certain embodiments, the lid is fastened to the club head body by a fastening mechanism that includes two or more screws having threaded posts that screw into threaded bores in the base of the channel. Preferably, fastening the lid in place by screwing the screws into the threaded bores will also fix the repositionable weight members in place within the club head. The lid, when closed, may provide a surface of a portion of the sole preferably having an area of at least 10 $cm^2$. This is useful for the aperture to provide a view into the interior volume (i.e., even when the lid is attached), which allows functional information to be included on an inside surface of the club and visible through the sole. The included information may include, for example, a printed guide that explains an effect of the weight positioning on club head performance. The lid may include a transparent window of a material such as acrylic, polycarbonate, glass, or crystal. The window preferably has an area of at least 9 square centimeters (i.e., an area equal to 3 cm×3 cm, but distributed in any shape). The lid may be made any suitable material and preferably includes a metal such as cast, forged, milled, or stamped stainless steel.

Figure 13:
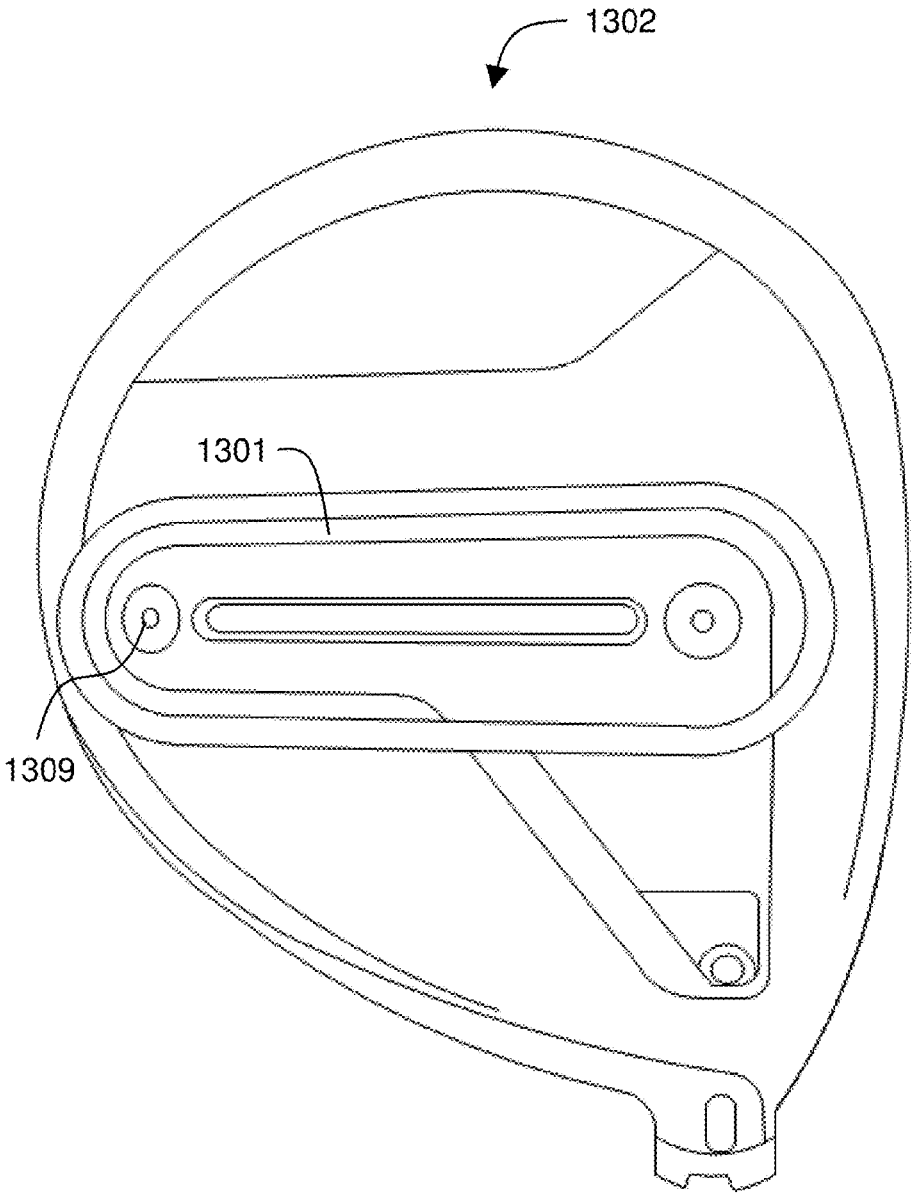
FIG. 13 shows a club head with an oval lid on a sole portion of the club head.

FIG. 13 shows a club head 1302 with an oval lid 1301 on a sole portion of the club head. The oval lid 1301 may be affixed to the club head via an attachment mechanism 1309 at either end of the oval.

Figure 14:
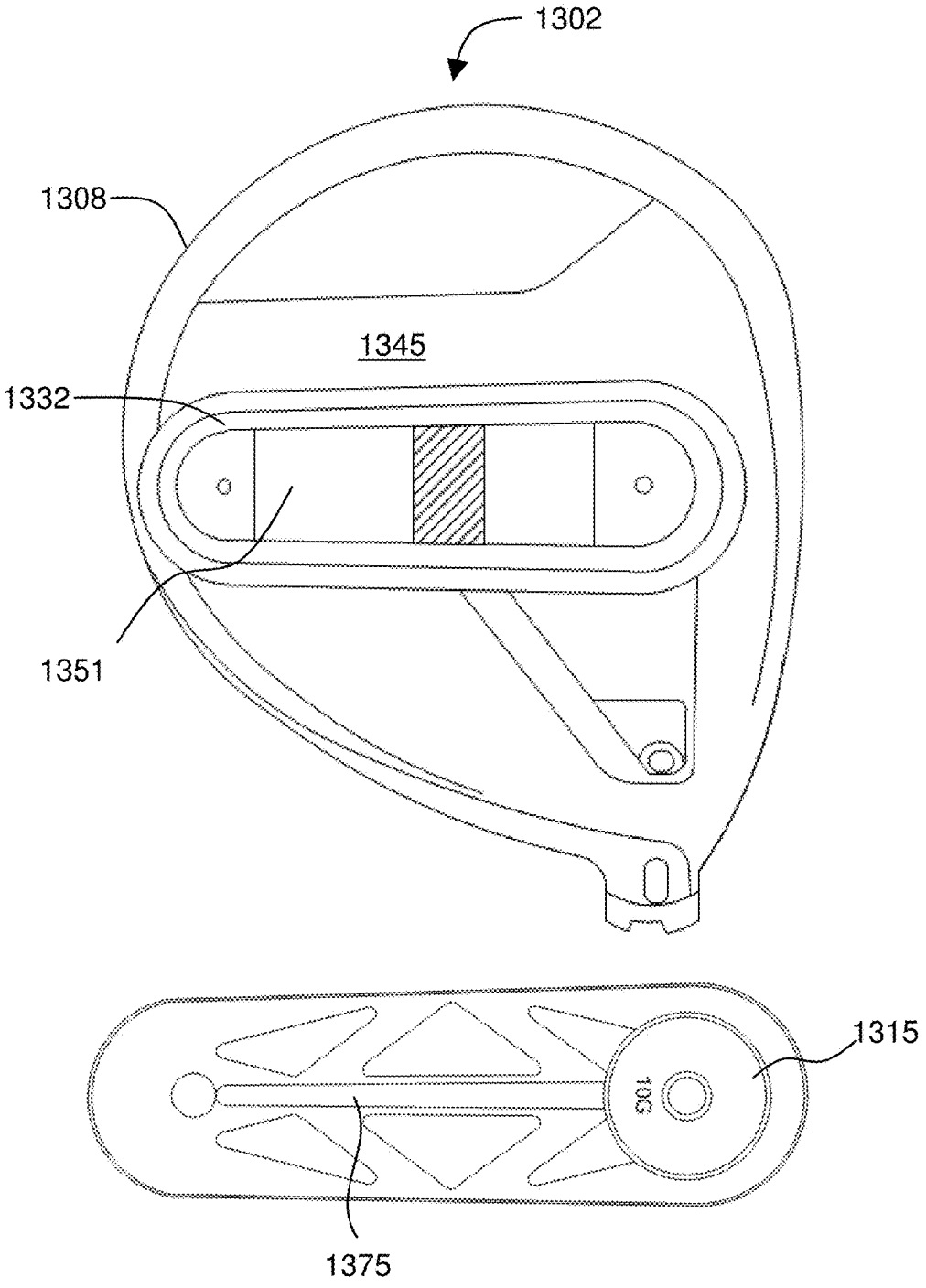
FIG. 14 shows a bottom of club head with the oval lid removed and an inside of the lid.

FIG. 14 shows a bottom of club head 1302 with the lid 1301 removed, and shows an inside surface of the lid 1301.

The golf club head 1302 includes a front portion defining a hosel extending upwards from a heel-side of a ball-striking face when the club head is at address and a crown portion and a sole portion 1345 extending back from the face and meeting to define a hollow club head body 1308 having an interior volume. The club head 1302 has a channel 1332 within the sole portion 1345. Within the channel 1332 is an aperture 1351 into the club head body providing access to the interior volume. The lid 1301 encloses the channel 1332 and the aperture 1351 to provide a substantially smooth continuation of the sole portion 1345. The lid 1301 includes a fastening mechanism 1309 (e.g., a screw that extends through the lid and is received by a threaded portion of the golf club head, or a quick-release mechanism, a hinge, a sliding mechanism, a twisting mechanism, a snap-fit mechanism, a magnet, or a tab/slot combination) to hold the lid 1301 in a closed position when the golf club head 1302 is used in golf. Preferably, when the lid 1301 is held in the closed position, a surface of the lid and an outer surface of the sole portion define a substantially smooth, downward facing surface when the club head is at address, the surface having no gaps or openings greater than 5 mm across.

The aperture 1351 and lid 1301 can be used to provide a club head 1302 with an adjustment mechanism within the interior volume (e.g., an adjustment mechanism that uses an adjustable weight member). In the depicted embodiment, the lid 1301 is part of a mechanism for holding one or more repositionable weight members 1315 into desired positions. The aperture 1351 defines one or more openings through the sole. The use of a lid 1301 with two or more mount points (e.g., fastening mechanisms 1309) to enclose the channel 1332 adds rigidity relative to a channel that is not enclosed. Due to the added rigidity, it may be permissible to include the aperture 1351. This combination—a lid covering a channel in the sole and an aperture through that channel—locates mass on the club head in a distribution that will be beneficial to many players.

Preferably, the lid 1301 is fastened to the club head body 1308 by a fastening mechanism 1309 that includes two or more screws having threaded posts that screw into threaded bores in the channel 1332. It can be understood from FIG. 14 that fastening the lid 1301 in place will also fix the repositionable weight members 1315 in place within the club head 1302. The lid, when closed, provides a surface of a portion of the sole preferably having an area of at least 13 $cm^2$. In the depicted embodiment, the lid 1301 may include a window 1375 to allow a golfer to view a present effective setting of the repositionable weights 1315.

FIGS. 15-22 show components of a golf club with stackable discs in a removable panel.

Figure 15:
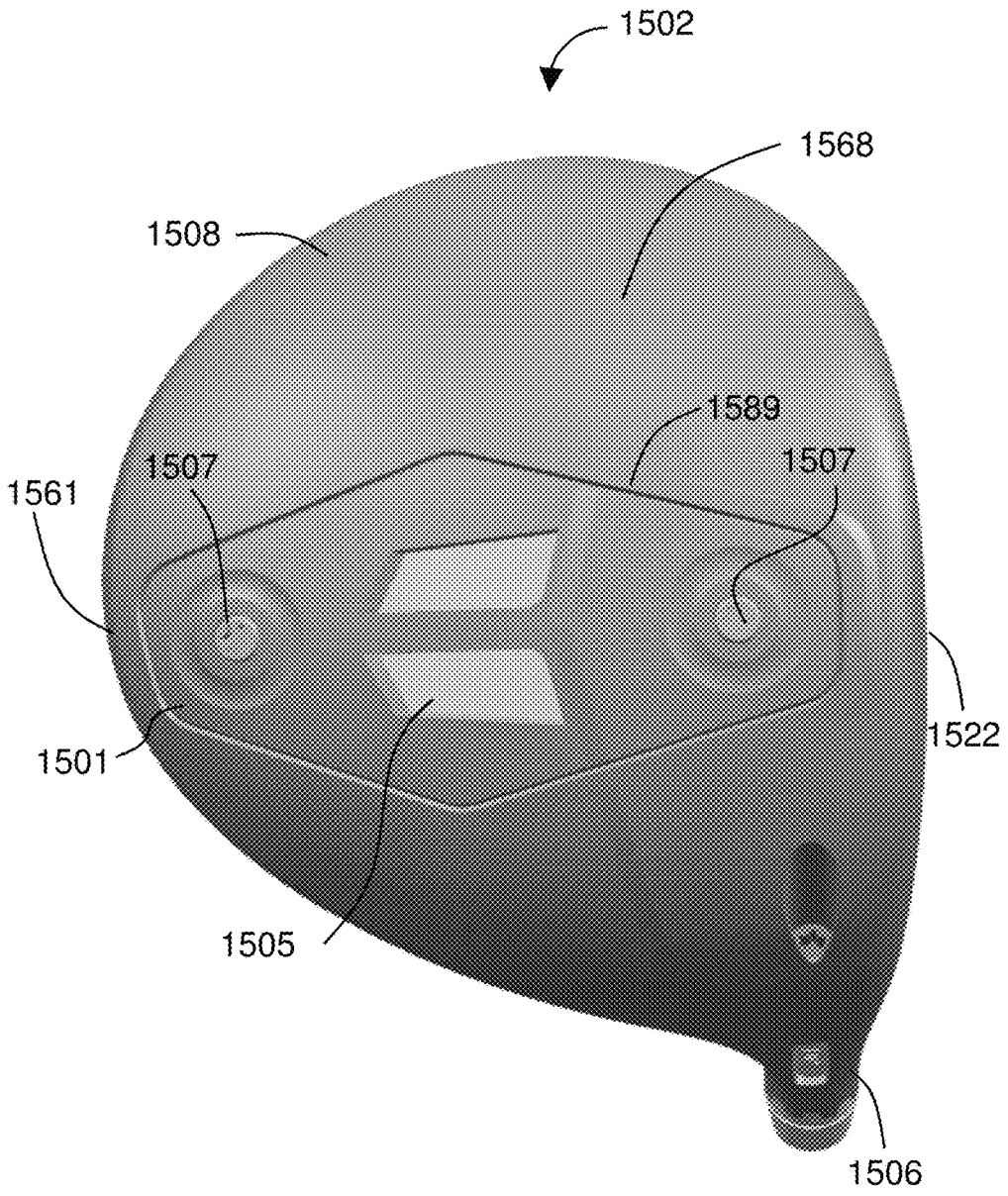
FIG. 15 shows a golf club head with stackable discs shielded by a removable panel.

FIG. 15 shows a golf club head 1502 that includes a ball-striking face 1522 at a front portion of the club head 1502 with a crown and a sole 1568 extending back from the ball striking face 1522. The crown meets the sole at a heel side, a toe side, and an aft portion 1561 of the club head. The ball-striking face, the crown, and the sole define a hollow interior volume of the club head. A hosel 1506 extends up from the heel side of the front portion of the club head. The club head 1502 includes an opening 1589 through the club head. A removable panel 1501 encloses the opening 1589 through the club head.

The removable panel 1501 provides internal access. When the removable panel 1501 is removed, access is provided to the internals of the head. The removable panel 1501 optionally includes one or more windows 1505. Windows 1505 preferably include transparent panes, e.g., of polycarbonate. The removable panel 1501 is attached to the head 1502 with screws 1507.

Figure 16:
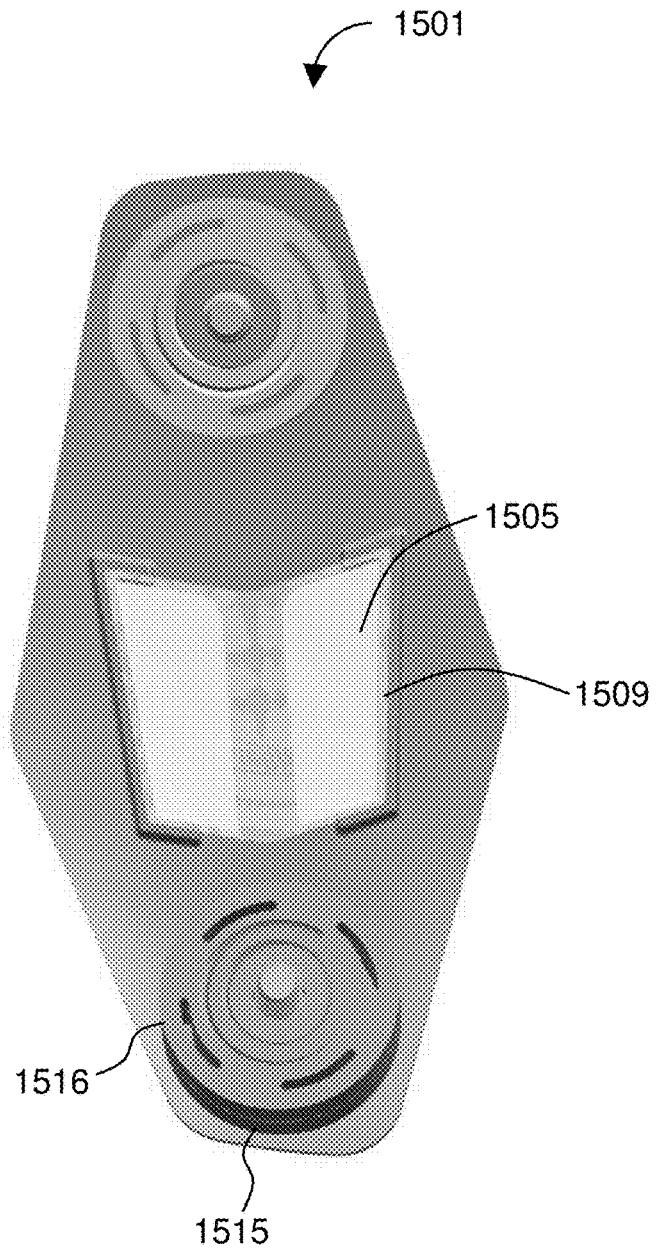
FIG. 16 shows the removable panel for the stackable discs.

FIG. 16 shows the removable panel 1501, designed to receive two discs that are hand tightened to the inside of the door. The discs can be removed and switched around to change the mass properties of the head. Once the discs are on the door, the door is then screwed onto the head. In preferred embodiments, the construction shown (see, e.g., FIG. 20 and FIG. 21A) allows the disc(s) to be hand-tightened because they are held in pace in part by other surrounding hardware. The panel 1501 preferably includes one or more openings 1509 that may be covered by a window 1505 (e.g., transparent polycarbonate).

Any suitable discs may be included. In preferred embodiments, the discs provide a set of weights with varying masses and a user can combine the weights in a variety of spatial patterns to tune a center of gravity location of the club head. Additionally or separately, one or more of the discs may provide other functionality. For example, a disc may include an electronic device. In some embodiments, one or more of the discs include one or more of a battery, an accelerometer, an RFID tag, an antenna, a microchip, memory, an input/output jack (e.g., a mini- or micro-USB port), an electrical contact point or jack, a piezoelectric sensor, clock, GPS sensor, others, or a combination thereof. For example, in one embodiment, the discs are stackable and have exposed electrical contact points. A base disc may include a battery and have copper spring contacts on a top surface. A top disc may include a piezoelectric shock sensor, memory, a chip, and I/O device such as RF antenna or mini-/micro-USB port. When assembled, the battery in the base disc powers the devices in the top disc. The piezoelectric shock sensor generates a signal each time a golfer takes a shot with club head 1502. A record of the shot, optionally with its time, location, or both, is recorded in the memory and the record may be transferred to a device such as a remote computer or smartphone. In the most preferred embodiments, the discs are weights with varying masses and are stackable.

Figure 17:
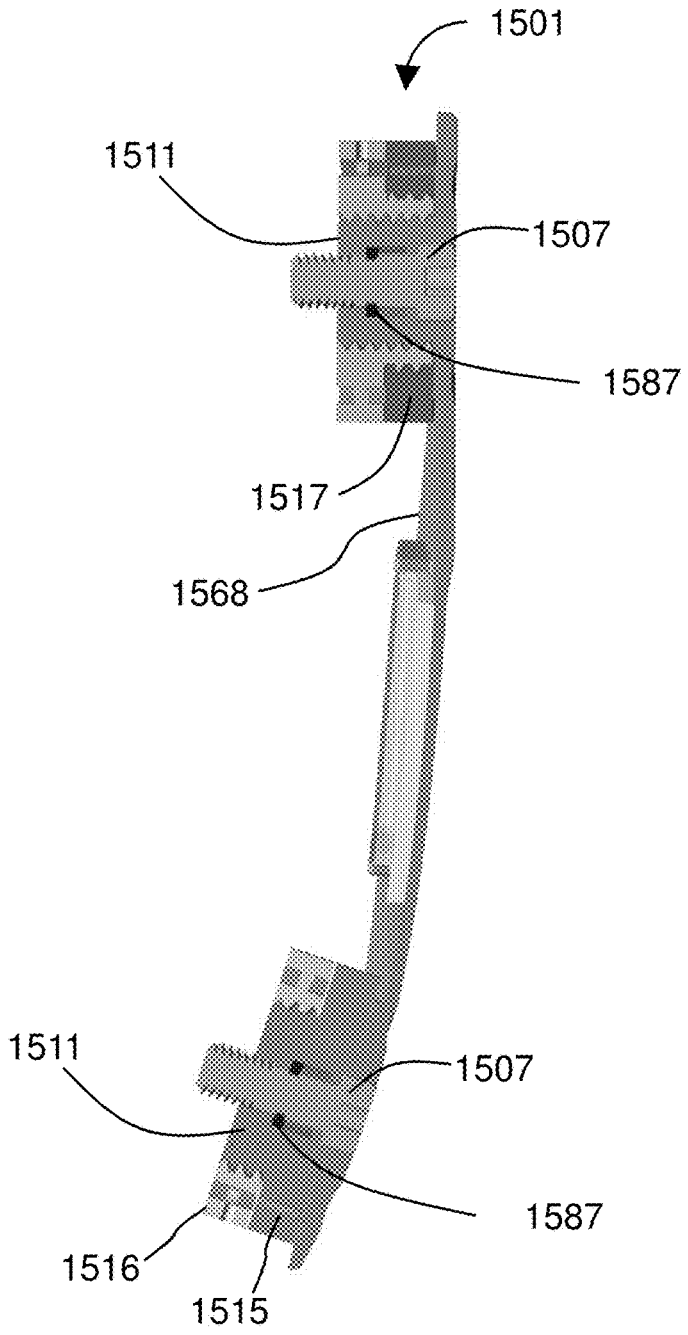
FIG. 17 is a cross-section through the removable panel and a set of stackable discs.

FIG. 17 is a cross-section through the removable panel 1501 and a set of stackable discs that includes first base disc 1515, first top disc 1516, second base disc 1517, and a second top disc 1518. The discs are screwed onto the panel 1501. This view also shows how the door screws 1507 are retained (e.g., by clips) to the panel 1501. FIG. 17 shows a post 1511 on an inside surface 1568 of the panel 1501.

A first disc 1515 is removably attached to the post 1511. As shown in FIG. 17, the removable panel 1501 includes a first screw 1507 held within the post 1511 via a clip ring 1587 and a second screw 1507 held within the second post 1511 by a second clip ring 1587.

Figure 18:
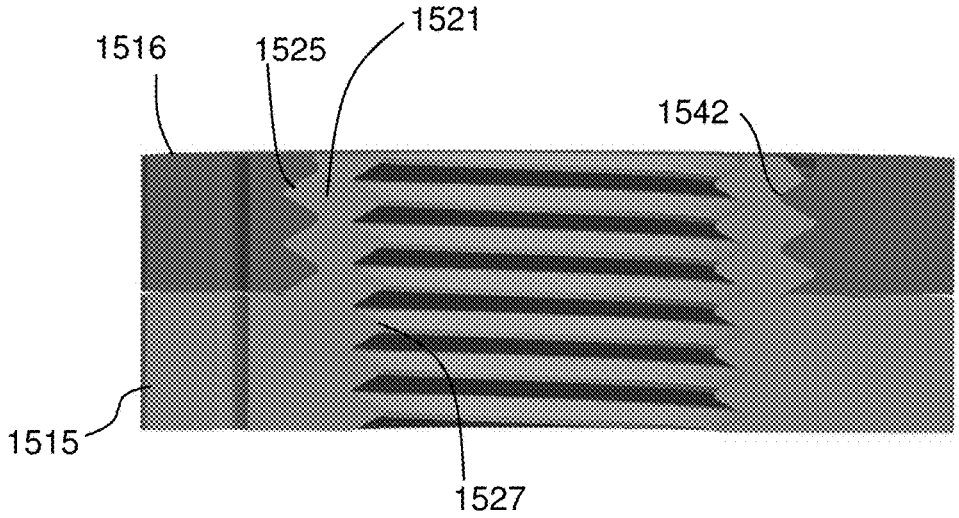
FIG. 18 shows a disc assembly.

FIG. 18 shows a disc assembly with the first base disc 1515 and the first top disc 1516. The discs are designed in two pieces, male (first base disc 1515) and female (first top disc 1516). The first top disc 1516 is screwed onto the first base disc 1515 and the first base disc 1515 is then screwed onto the panel 1501.

In certain embodiments, the golf club head 1502 is provided with two disc assemblies, each having two discs (e.g., first base disc 1515 and first top disc 1516 can be disposed at one end of the panel 1501; the second base disc 1517 and the second top disc 1518 can be disposed at an opposed end of the panel 1501). Both male and female components of the first disc are heavy (e.g., about 20 grams combined) while both components of the second disc are light (e.g., about 5 grams). This design then allows for 3 different disc settings once attached to the door (front middle back).

Figure 19:
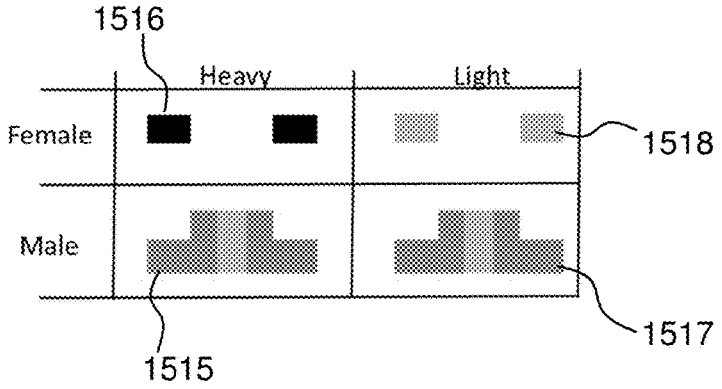
FIG. 19 illustrates the use of stackable weights in the disc assembly
Figure 19:
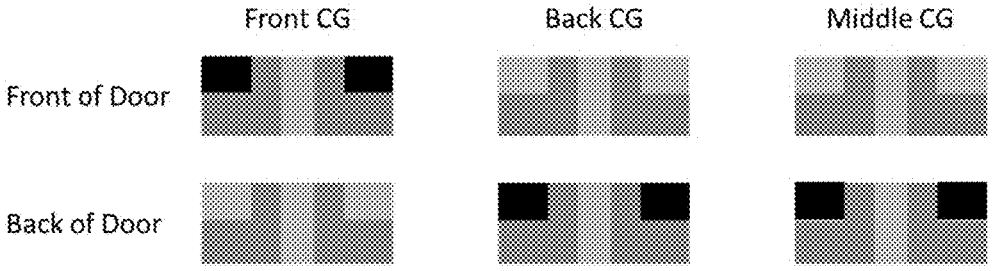

FIG. 19 is a graphic illustrating the use of the disc assembly according to the most preferred embodiments. A club head 1502 may be provided with a first base disc 1515, first top disc 1516, second base disc 1517, and a second top disc 1518. FIG. 19 shows that the first top disc 1516 has a first mass ("heavy") and the second top disc 1518 has a second mass "(light") unlike the first mass. It may be preferable that the first base disc 1515 and the second base disc 1517 are also, respectively, "heavy" and "light". The bottom portion of FIG. 19 shows the different combination of discs to achieve three different settings with the discs. In fact, FIG. 19 is an exemplary graphic that may be provided to a user of the club head 1502. The graphic may be in the form of printed matter that comes with the club head, or may be printed on an inside surface of the club head itself.

Because the club head 1502 preferably includes one or more openings 1509 (that may be covered by a window 1505 such as of transparent polycarbonate), a graphic printed within the club head may be viewed by a golfer. In fact, where the discs are themselves color-coded, a golfer can peer through the openings 1509 (e.g., while out on a golf course) and see a current setting of the mix-and-match stackable weights, and also see the graphic indicating what CG characteristics are provided by the current setting. For example, the front CG setting could be labeled as provided long drives that bore forward, for better players, whereas the back CG setting could be labelled as provided forgiveness for off-center hits. Thus the inclusion of the window or openings 1509 may provide a benefit when in conjunction with the stackable weight discs. The stackable weight discs provide a benefit in offering a finely tunable club head. Positioning the stackable weight discs on an inside surface of an openable/closeable club head provides a significant benefit in that the mechanisms of the stackable weight discs do not affect aerodynamics, sound, or turf interaction.

Figure 20:
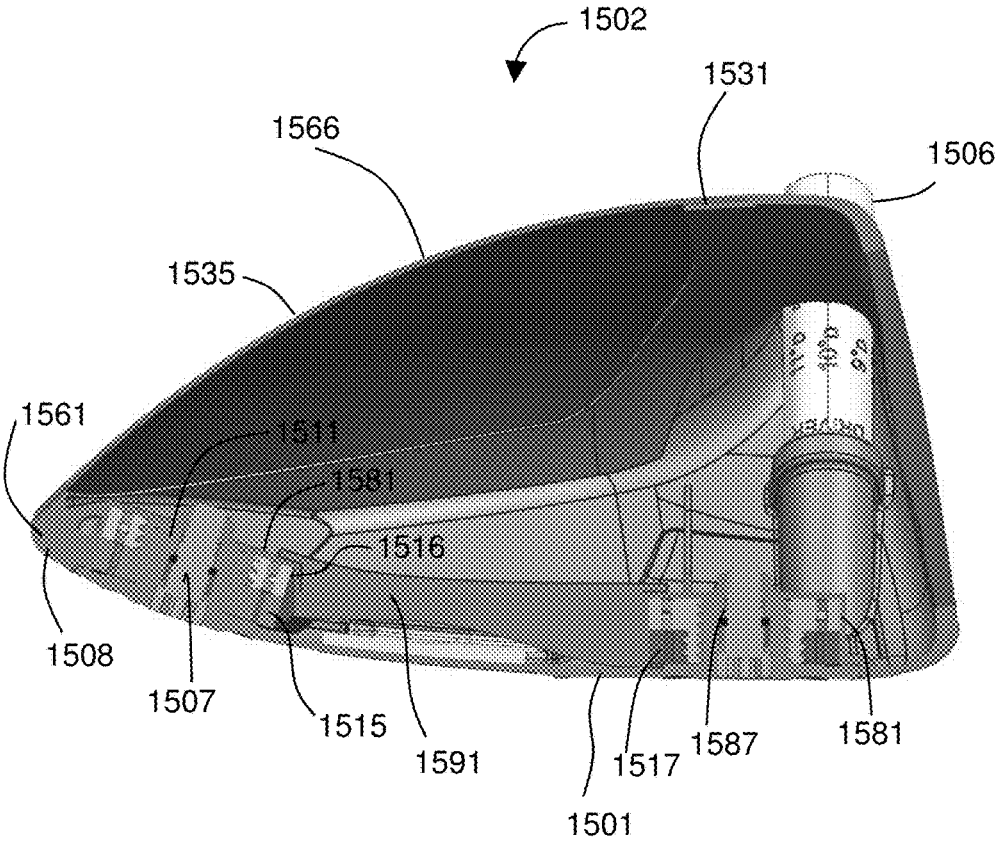
FIG. 20 is a cross-section through the club head with stackable discs.

FIG. 20 is a cross-section through the club head 1502, showing the panel 1501 with a disc assembly (first base disc 1515, first top disc 1516, second base disc 1517, and a second top disc 1518) disposed therein on an inside surface of the panel 1501. The club head 1502 includes a club head body 1508 (which may, e.g., be a single milled or cast piece of a material such as titanium or aluminum). The club head body 1508 preferably includes a ledge 1531 defining a cutaway void for mounting a crown piece 1535. The club head body 1508 includes two wells 1581 that receive the disc assemblies when the panel 1501 is attached to the club head 1502. The cross-sectional view shows how the panel 1501 fits into the cast body. Once the discs are screwed onto the panel 1501 they then sit in the wells 1581 and the screws 1507 fix the panel 1501 to the cast body 1508. As shown in FIG. 20, the opening 1589 may be on the sole 1568 of the golf club head 1502. When the removable panel 1501 is attached to the club head 1502, the screws 1507 are received by threaded bores in the wells 1581.

The cross section also shows a rib 1591 extending between the two wells 1581 in the club head body 1508. Preferably the club head body 1608, the two wells 1581, and the rib 1591 are formed as a single cast piece. The rib 1591 is designed to have no interference with the panel 1501 or the discs. This is why, in preferred embodiments, the bottom of the rib does run flat against the door.

Figure 21A:
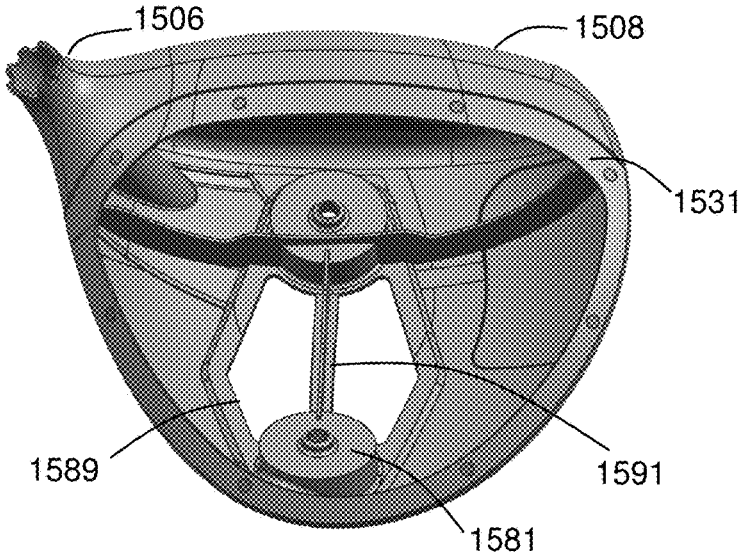
FIG. 21A shows internal castings of a club head body.

FIG. 21A shows the internal castings of club head body 1508. An opening 1589 through the club head body 1508 is defined by an edge of the body around a perimeter of the opening. The two wells 1581 are located at opposed ends of the aperture and the two wells 1581 are connected by the rib 1591. The club head body 1508 includes a ledge 1531 to which the crown piece 1535 (not shown in FIG. 21A) may be mounted.

Figure 21B:
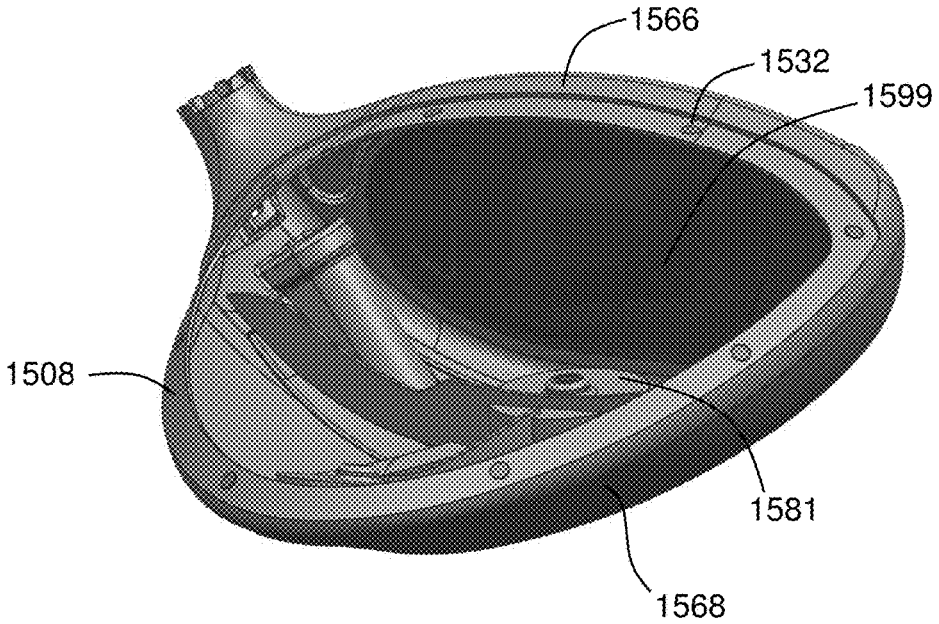
FIG. 21B is a perspective view of the internal castings.

FIG. 21B is a perspective view of the internal castings of the club head 1501. The club head body 1508 includes the rib 1591 spanning the space between the two wells 1581. The club head body 1508 is cast with an adjustable hosel mechanism for operability with an adjustable shaft mechanism. As shown in FIG. 21A and FIG. 21B, the club head body 1508 provides at least a portion of the sole 1568. The club head body piece 1508 includes the hosel 1506 and a ledge 1531 extending around an area of the crown. The ledge 1531 defines an opening 1599 through a crown region of the club head body 1508. The club head body 1508 includes two wells 1581 configured to receive the first disc and the second disc when the removable panel is attached to the club head.

The ledge 1531 includes proud dots 1532. When the club head body 1508 and the crown piece 1535 are assembled to form the club head 1502, the presence of the dots 1532 causes the crown piece 1535 to be spaced away from the ledge 1531 by a controlled and uniform distance. As a result, the adhesive used to bond the crown piece 1535 to the ledge 1531 (e.g., epoxy) has a controlled and uniform thickness. Thus the inclusion of dots 1532 allows the body 1508 to come out of the casting in a form to make attachment of the crown easy and secure. For example, where the crown piece 1535 is made of carbon fiber, the club head can be assembled by applying epoxy to the ledge 1531 (e.g., of the titanium cast body 1508) and pressing the crown piece 1535 into place. Additionally, inclusion of the opening 1589 allows excess adhesive to be removed from within the club head 1502. Thus, for example, after epoxying the crown piece 1535 to the ledge 1531, excess epoxy can be wiped off from inside surfaces and outside surfaces of the club head 1502. As a result of the controlled epoxy thickness provided by the positive dots 1532 and the ability to wipe excess epoxy from an inside surface of the club head 1502 provided by the opening 1589, when the club head 1502 is made, the epoxy (or other adhesive) used to attach the crown has a predictable mass.

Figure 22:
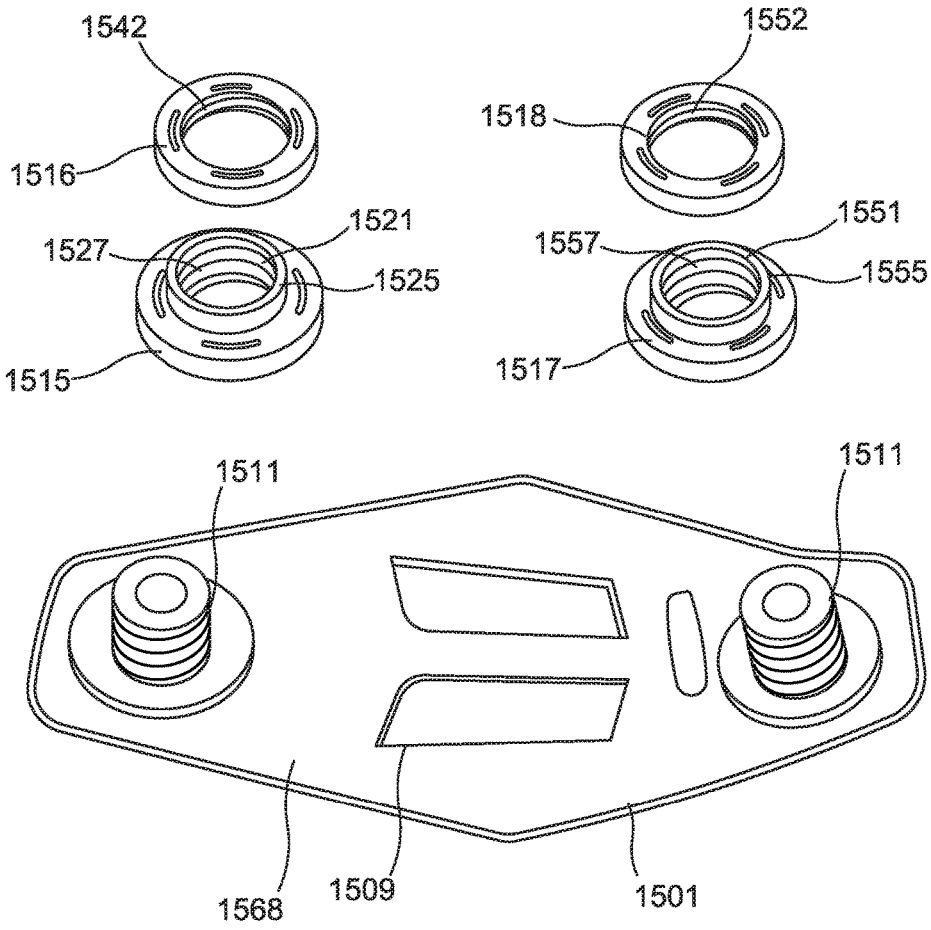
FIG. 22 shows the removable panel and the discs.

In certain preferred embodiments, the crown piece 1535 is carbon fiber with about 4 plies of prepreg unidirectional (UD) tape and optionally at least one ply of the carbon fiber yarn-based composite material sold under the trademark TEXTREME by Oxeon AB (Sweden). FIG. 22 shows the removable panel 1501, the first base disc 1515, the first top disc 1516, the second base disc 1517, and the second top disc 1518. As shown in FIG. 22, the inside surface 1568 with the post 1511 may be on the removable panel 1501. Preferably the removable panel 1501 includes a second post 1511 on the inside surface. A second disc 1517 may be removably attached to the second post.

The removable panel 1501 has two posts 1511 to which the disc assemblies (one being the first base disc 1515 and the first top disc 1516; another being the second base disc 1517 and the second top disc 1518) attach. The removable panel 1501 also includes one or more openings 1509 therethrough.

The first base disc 1515 has a disc-shaped body with a first mount-point 1521 extending up from an upper surface of the disc-shaped body. The first mount-point 1521 has a first internal, female-threaded surface 1527 (complementary to the posts 1511) and a first external, male-threaded surface 1525.

The first top disc 1516 is substantially disc-shaped with a bore defining a first threaded inner surface 1542 (complementary to the first external, male-threaded surface 1525 on the first base disc 1515 as well as to the second external male-threaded surface 1555 on the second base disc 1517.

The second base disc 1517 has a disc-shaped body with a second mount-point 1551 extending up from an upper surface of the disc-shaped body. The second mount-point 1551 has a second internal, female-threaded surface 1557 (complementary to the posts 1511) and a second external, male-threaded surface 1555.

The second top disc 1518 is substantially disc-shaped with a bore defining a second threaded inner surface 1552 (complementary to the first external, male-threaded surface 1525 on the first base disc 1515 as well as to the second external male-threaded surface 1555 on the second base disc 1517).

Figure 23:
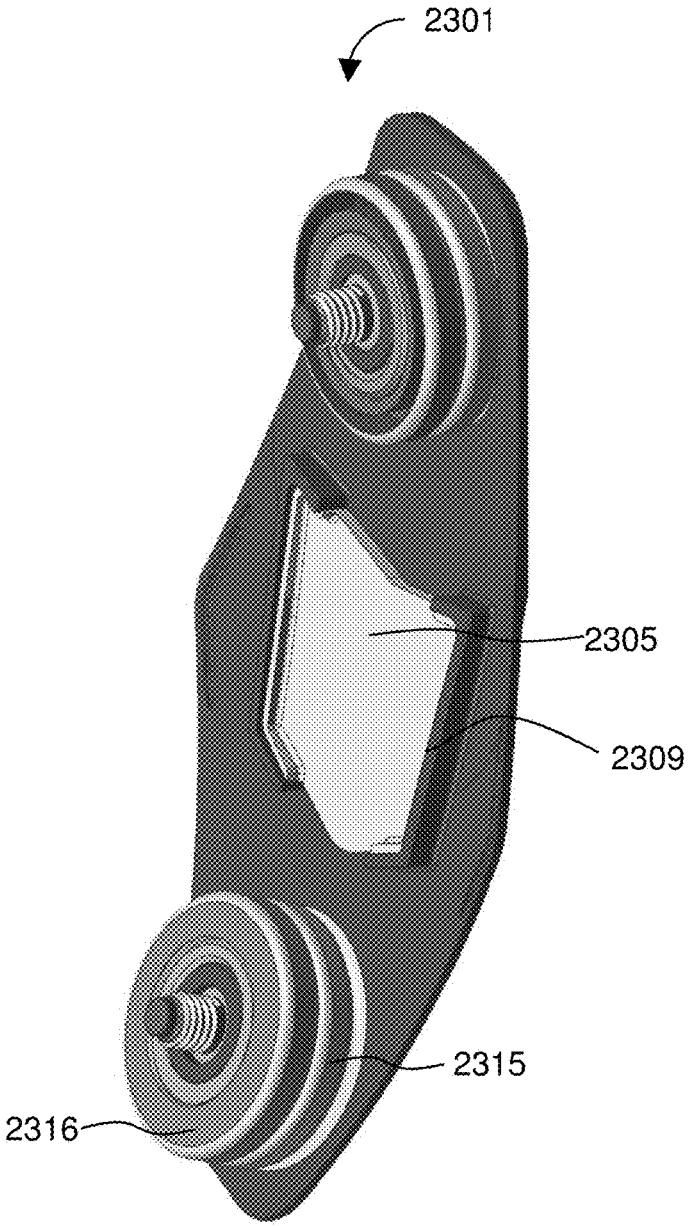
FIG. 23 shows a windowed removable panel according to another embodiment.

FIG. 23 shows a windowed removable panel 2301 according to another embodiment with stackable weights. The windowed removable panel 2301 has stackable discs including at least a base disc 2315 and a top disc 2316. The panel 2301 is an alternative embodiment to the panel 1501. The panel 2301 includes an opening 2309 that is preferably filled with a window 2305 (e.g., of transparent or translucent polycarbonate or similar). The panel 2301 may be preferable to the panel 1501 for some applications because the window 2305 is larger and provides a greater viewing area than the window in the panel 1501.

The golf club head 1502 with stackable discs in a removable panel 1501, as shown in FIGS. 15-22, provides a number of useful benefits. Using the described structure, there is no need for an assembly or boss to hold the disc in the head. One or more of the discs may be provided as magnetic weights, e.g., along with an electromagnetic tool to disengage the discs. The discs may have variable diameters. In preferred embodiments as shown, the discs screw together and are stackable. As discussed above, one or more of the discs may include an electronic device.

FIG. 24A-FIG. 33 show a golf club head 2802 with a disc port 2875.

Figure 24A:
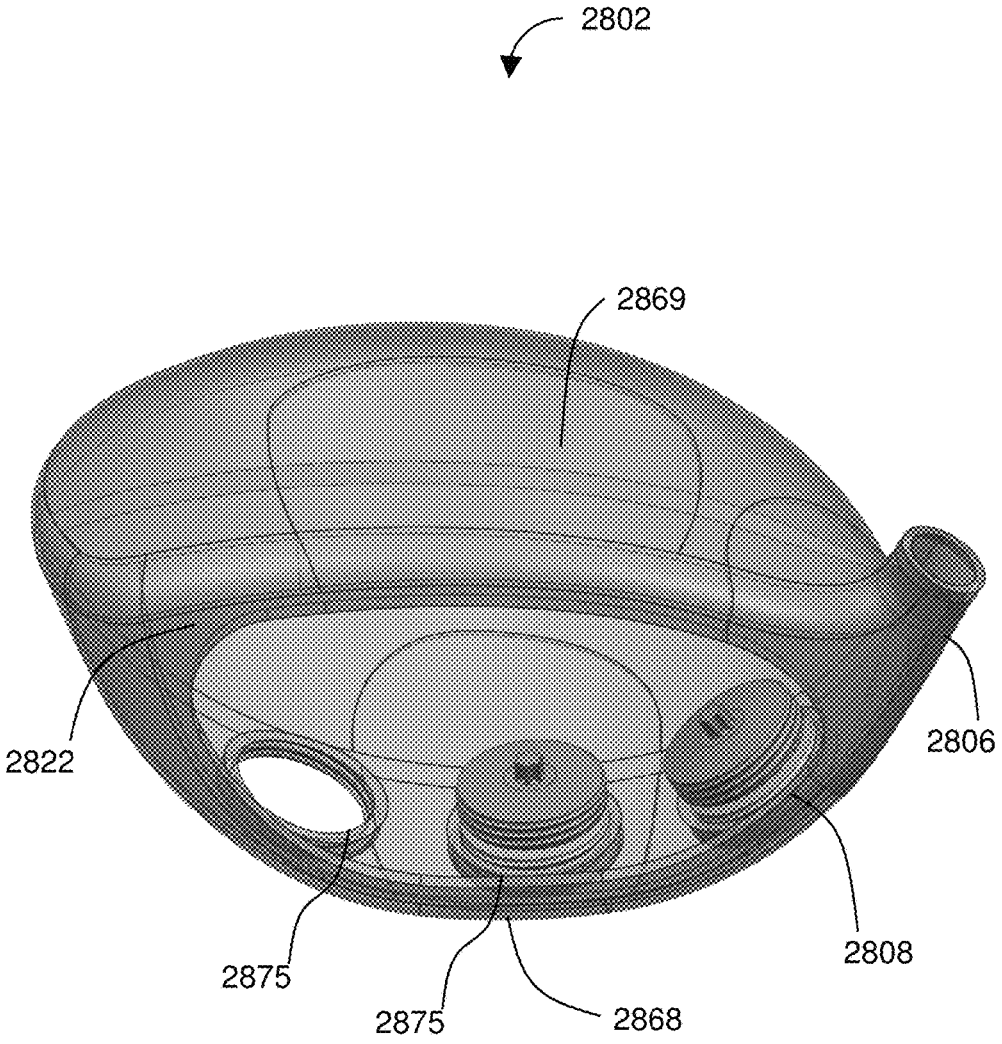
FIG. 24A shows a golf club head with weight ports according to certain embodiments.

FIG. 24A shows details of a golf club head 2802 according to certain embodiments. The golf club head 2802 is preferably a hollow, wood-type club head. The club head 2802 includes at least one disc port 2875. As shown in FIG. 24A, the club head 2802 includes three of the disc ports 2875. The club head 2802 includes a ball-striking face 2822 at a front portion of the club head. A crown 2869 and a sole 2868 extend back from the ball striking face. The crown 2869 meets the sole at a heel side, a toe side, and an aft portion of the club head. The club head 2802 is preferably a hollow, wood-type club head. Wood-type club heads include drivers, fairways, and hybrids. The ball-striking face, the crown, and the sole define a hollow interior volume of the club head 2802. A hosel 2806 extends up from the heel side of the front portion of the club head.

Three ports 2875 are disposed through the club head. The ports 2875 have a threaded inward-facing, ring-shaped surface. Preferably, the ports 2875 have a diameter of at least about 1 cm, such that when the threaded disc is removed from the port, the port provides an opening into the hollow interior volume with an area of at least $\pi(0.5\ \text{cm})^2$. More preferably, at least one of the ports has a diameter of about 2 cm. The port is preferably large enough that a tool may be inserted through the port 2875 and may reach an inside surface of the hollow interior volume of the club head 2802. Thus, for example, a tool could be used to screw or unscrew a bolt or screw on an inside surface of the crown 2869 when the tool is inserted through the port 2875 with a user's hand on the tool outside of the club head 2802.

Figure 24B:
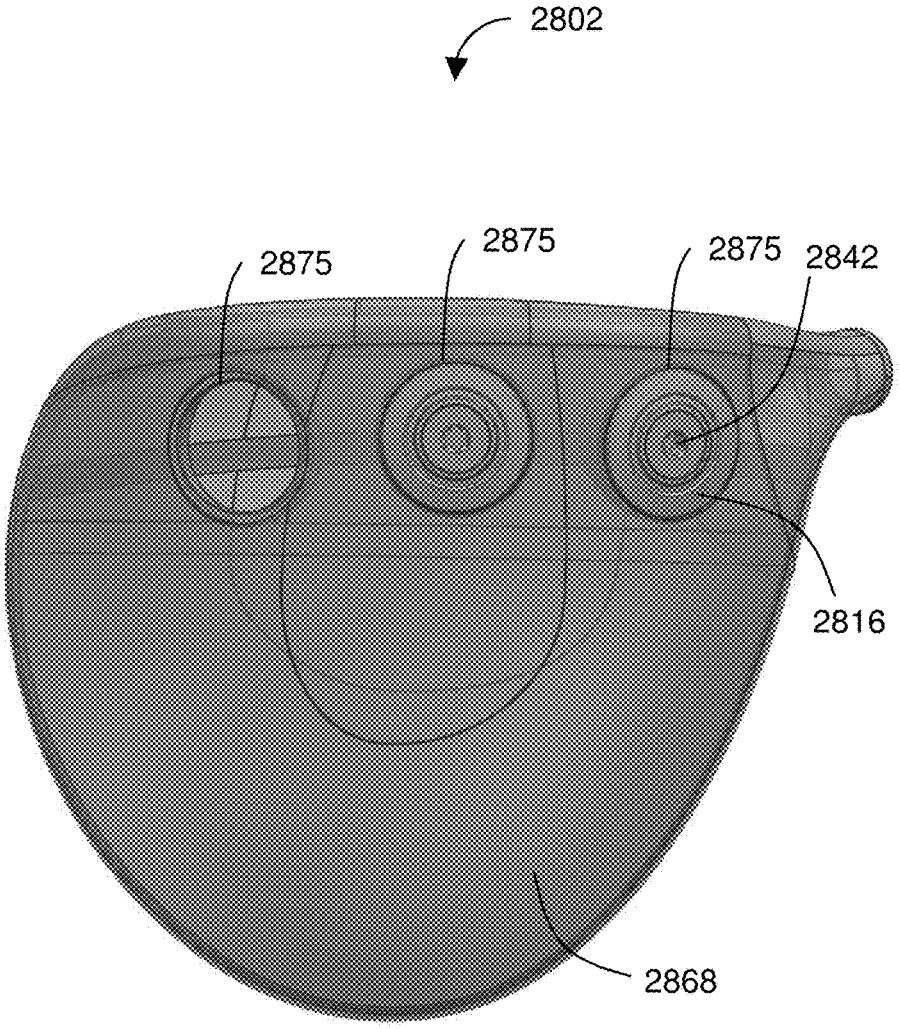
FIG. 24B is a bottom view of the club head with three ports.

FIG. 24B is a bottom view of the club head 2802, showing the three ports 2875 disposed across the sole. One of the ports 2875 is central, one is heel-ward, and one is toe-ward. A flanged disc 2816 is threaded into the heel-ward port 2875, and another such disc is threaded into the central port. In preferred embodiments, the disc 2816 has a post and a slot 2842 on opposed surfaces, allowing similarly-formed discs to be stacked. Thus the disc 2826 may be provided as part of a set of stackable discs.

Figure 25A:
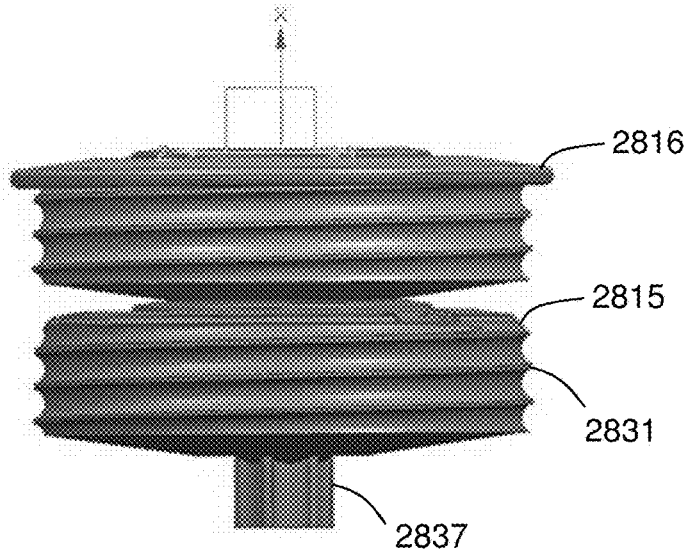
FIG. 25A shows a set of stackable discs for use with the club head.

FIG. 25A shows a set of stackable discs for use with the club head 2802. The stackable discs include a flanged disc 2816 and at least one stacking disc 2815.

Figure 25B:
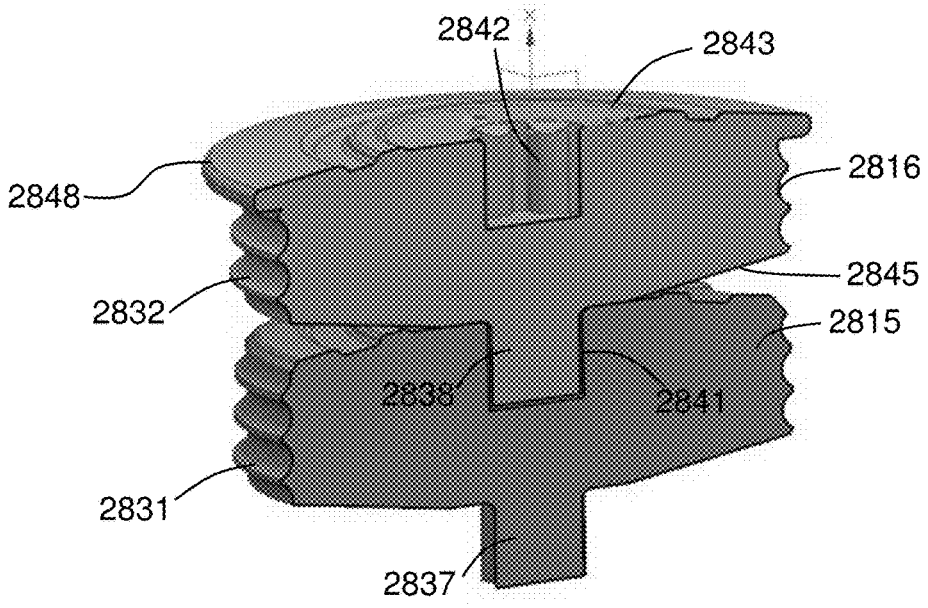
FIG. 25B is a cross-section through the stackable discs.

FIG. 25B is a cross-section through the flanged disc 2816 and the stacking disc 2815. The flanged disc 2816 has a main, disc-shaped body with a tool slot 2842 on one surface 2843 and a post 2838 on a second, surface 2845 opposed to the surface 2843. The body has a threaded surface 2832 and includes a flange 2848 extending outwards radially past the threaded surface 2832. The flange 2848 provides a stopping point when the threaded disc 2816 is screwed into the port.

The stacking disc 2815 has a main, disc-shaped body with a tool slot 2841 and a post 2837. The body has a threaded surface 2831.

The tools slot 2842 and the tool slot 2841 preferably have a shape complementary to a shape of the post 2838 and the post 2837. Any suitable shape may be used for the tool slot 2842 and the tool slot 2841 as well as the post 2838 and the post 2837. They may, for example, be given hex-shape or a star shape, such as the star-shaped drivers and heads sold under the trademark TORX by Acument Global Technologies Inc. (Sterling Heights, Mich.). The inclusion of the post and slot allows the discs to be stacked and also transmits torque applied to one of the discs to any disc stacked therewith.

Figure 26:
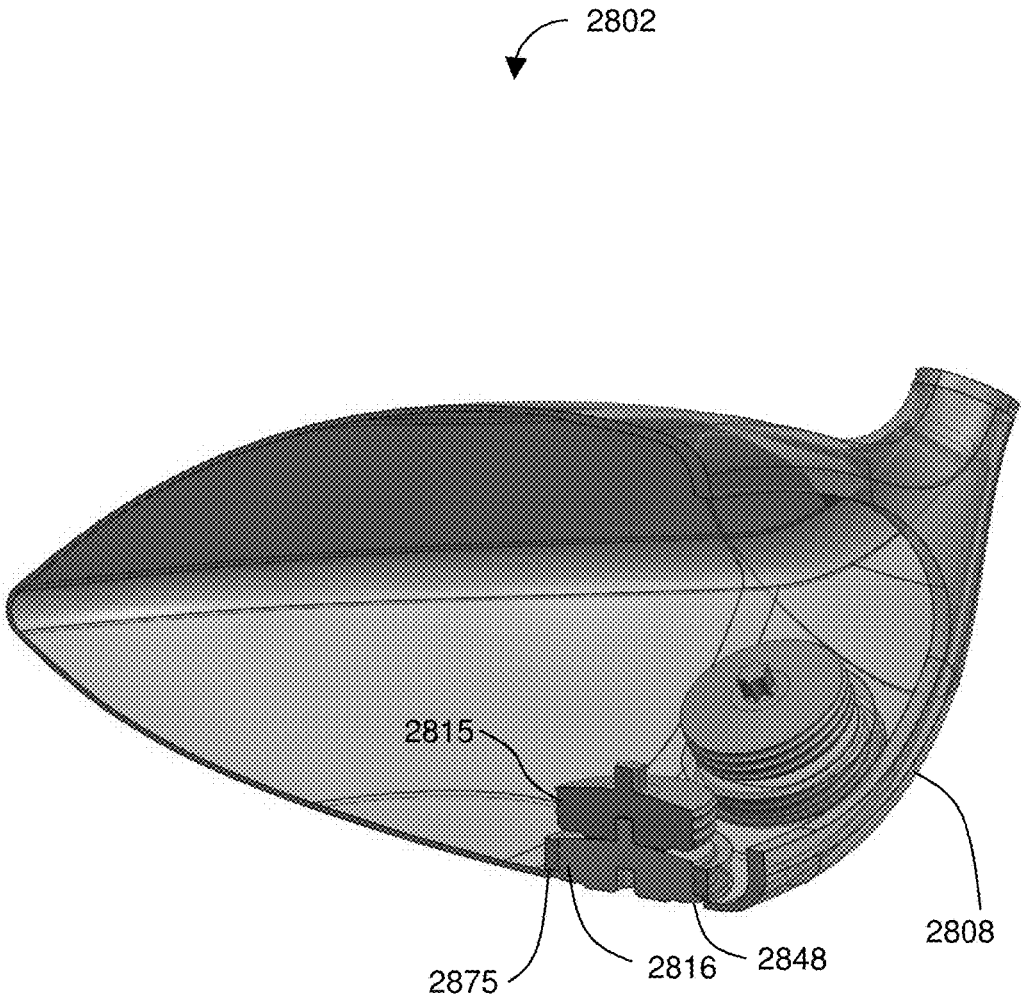
FIG. 26 shows one of the discs screwed into, and covering, one of the ports.

FIG. 26 shows one of the threaded discs 2816 screwed into, and covering, the middle port 2875. In fact, FIG. 26 shows the set of stackable discs installed in the disc port 2875 of the golf club head 2802. The club head body 2808 of the club head 2802 includes the disc port 2875. An inward-facing, ring-shaped surface of the disc port 2875 is threaded. The flanged disc 2816 and the stacking disc 2815 are threaded around their outer perimeters. The threaded perimeters of the flanged disc 2816 and the stacking disc 2815 mate with the threaded inward-facing, ring-shaped surface of the disc port 2875, allowing the stackable discs to be installed into the club head 2802 by screwing the discs into the disc port. The discs may screwed in initially by hand, and a tool, such as a star-shaped driver wrench, may be used to screw the discs in fully. As the stackable discs are screwed in, the flange 2848 extending outwards radially past the threaded surface 2832 of the flanged disc 2816 provides a stopping point. When the flange 2848 bottoms out on the disc port 2875, the golfer knows that the stackable discs are fully installed.

Figure 27:
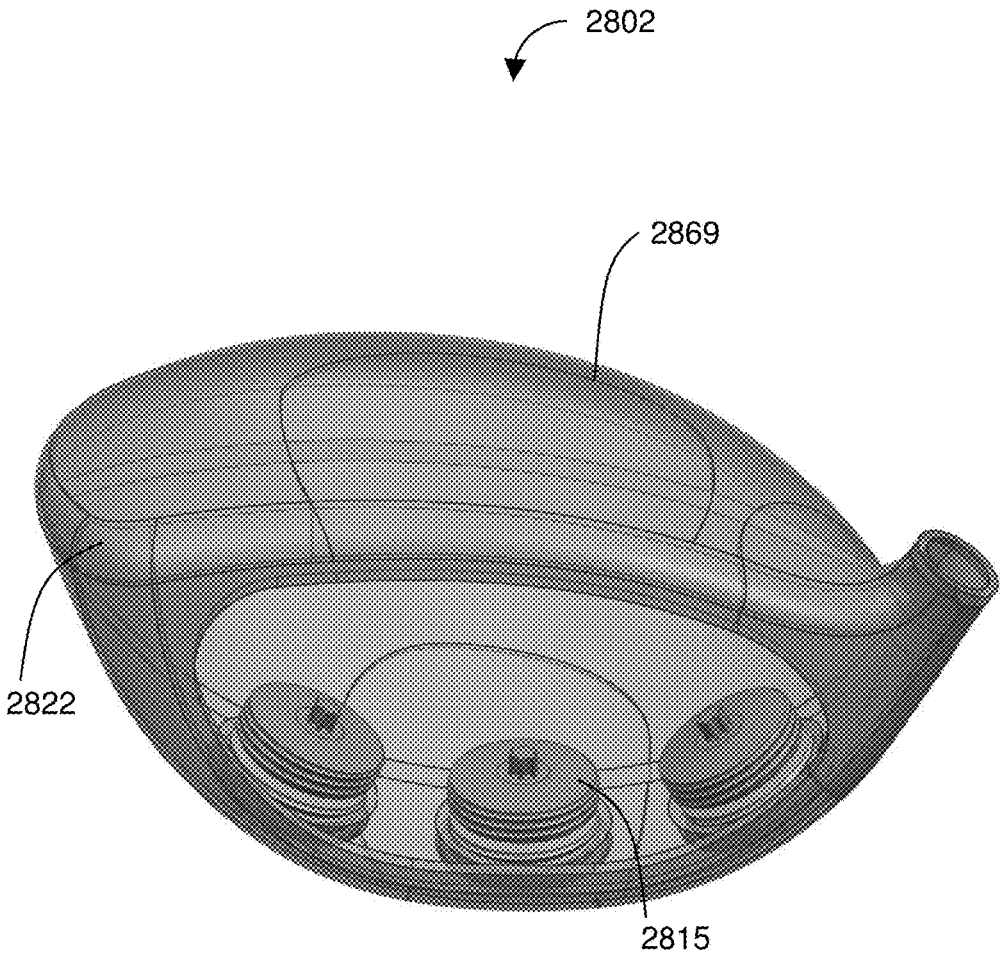
FIG. 27 shows the club head with the stackable discs installed.

FIG. 27 shows the club head 2802 (with the face insert cutaway) with the stackable discs installed. The stacking discs 2815 may extend into, and be exposed to, an open interior volume of the hollow, wood-type club head. By having the disc port 2875 open to the interior, any number of the stackable discs may be installed.

In the most preferred embodiments for club head 1802, the flanged disc 2816—when screwed into the port 2875—fills and encloses the port 2875. In those embodiments, the port 2875 has a diameter equal to a diameter of the flanged disc 2816. I.e., the port 2875 does not have an "inner, bottom" surface. Thus the club head 2802 offers the ability to customize mass distribution without any requirement for the club head to include bosses or pockets that require a large mass of material. Additionally, since the port 2875 is open to an open interior volume of the club head, the stackable discs can be stacked. Two or more of the discs can be stacked. Additionally, the ports 2875 when opened provide unimpeded access to all interior surfaces of the club head 2802: a golfer may view, for example, an underside of the crown 2869 or a portion of a shaft mechanism that extends through hosel 2806.

Any suitable discs may be included for the flanged disc 2816 and the stacking disc 2815. In preferred embodiments, a user can choose different masses for the flanged disc 2816 and the stacking disc 2815 and can thus adjust a location of a center of gravity of the club head. Additionally or separately, one or more of the discs may provide other functionality. For example, a disc may include an electronic device. In some embodiments, one or more of the discs include one or more of a battery, an accelerometer, an RFID tag, an antenna, a microchip, memory, an input/output jack (e.g., a mini- or micro-USB port), an electrical contact point or jack, a piezoelectric sensor, clock, GPS sensor, others, or a combination thereof. For example, in one embodiment, the discs are stackable and have exposed electrical contact points. One disc may include a battery and have copper contacts on a top surface. Another disc may include complementary contacts on a surface as well as a piezoelectric shock sensor, memory, a chip, and/or an I/O device such as RF antenna or mini-/micro-USB port. When assembled, the battery in the one disc powers the devices in the other disc. The piezoelectric shock sensor generates a signal each time a golfer takes a shot with club head 1502. A record of the shot, optionally with its time, location, or both, is recorded in the memory and the record may be transferred to a device such as a remote computer or smartphone. In the most preferred embodiments, the discs are weights with varying masses and are stackable.

Figure 28:
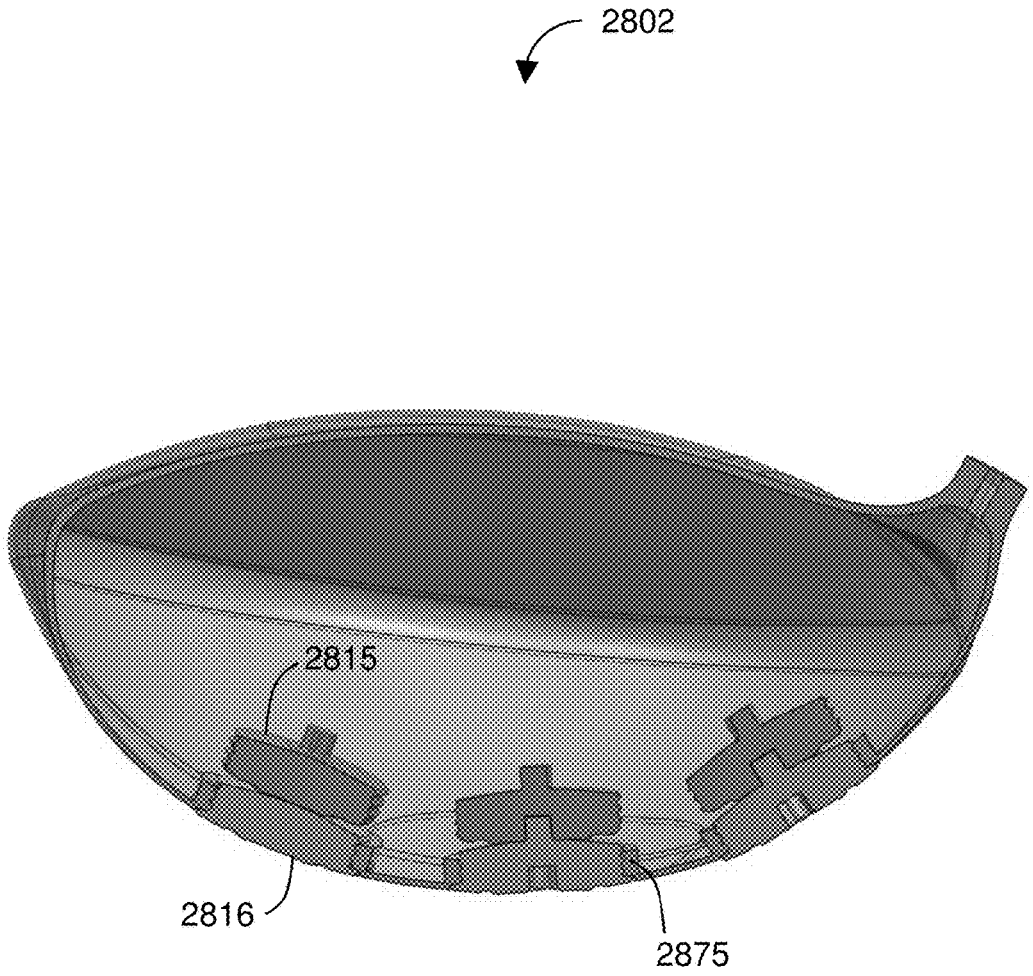
FIG. 28 is a cross-section through the club head with discs in the ports.

FIG. 28 is a cross-section through the club head 2802, showing the three weight ports 2875, each with a flanged disc 2816 and a stacking disc 2815. Any of the flanged discs 2816 and the stacking discs 2815 may independently be placed in any of the weight ports. Numerous discs can be attached to the club head 2802 at three different spots (or more, if additional disc ports are included).

Figure 29A:
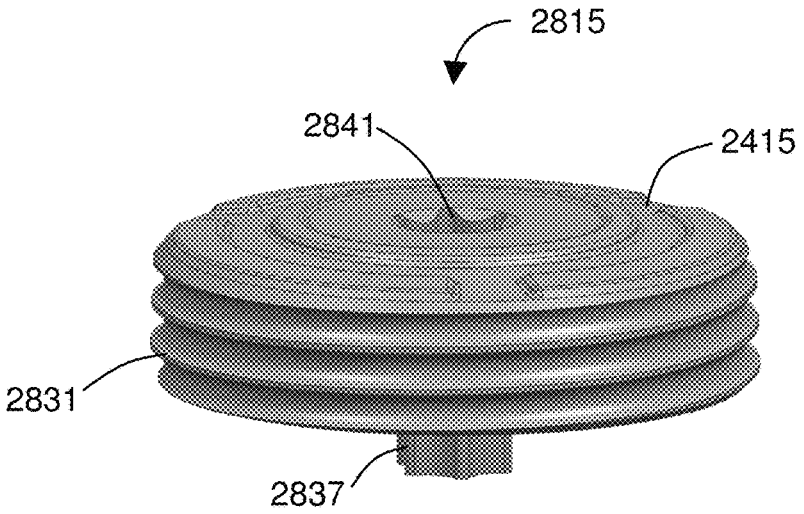
FIG. 29A gives a perspective view of a stacking disc.

FIG. 29A gives a perspective view of the stacking disc 2815. The stacking disc 2815 has a main, disc-shaped body with a tool slot 2841 and a post 2837. The body has a threaded surface 2831.

Figure 29B:
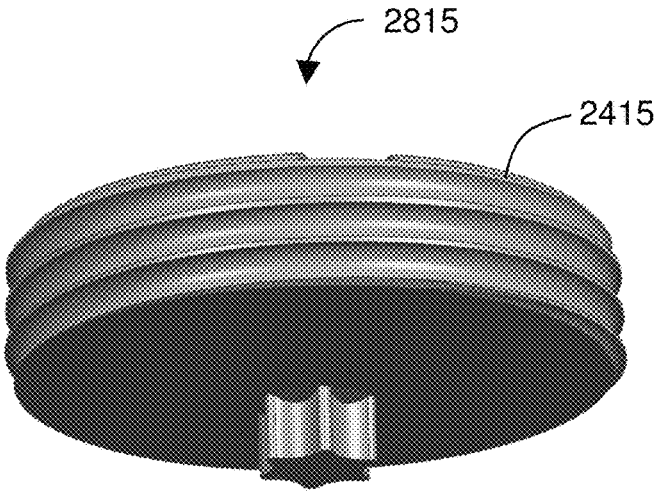
FIG. 29B gives a perspective view from beneath the stacking disc.

FIG. 29B gives a perspective view from beneath the stacking disc 2815.

Figure 30:
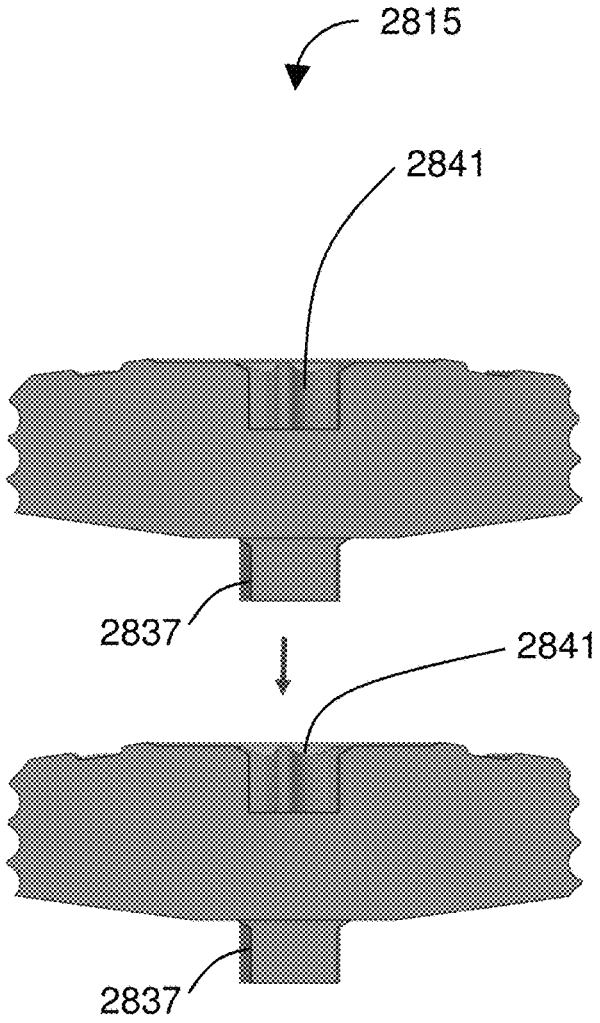
FIG. 30 diagrams how two of the stacking discs may be stacked.

FIG. 30 diagrams how two of the stacking discs 2815 may be stacked. A first one is pushed into a second one so that post 2837 is received in slot 2841. The post 2937 acts as a tool, engaging the slot 2814 so that when the top disc is rotated, the lower disc is also caused to rotate. A stack of two, three, four, or more of the discs may be assembled and rotated in such fashion.

Figure 31:
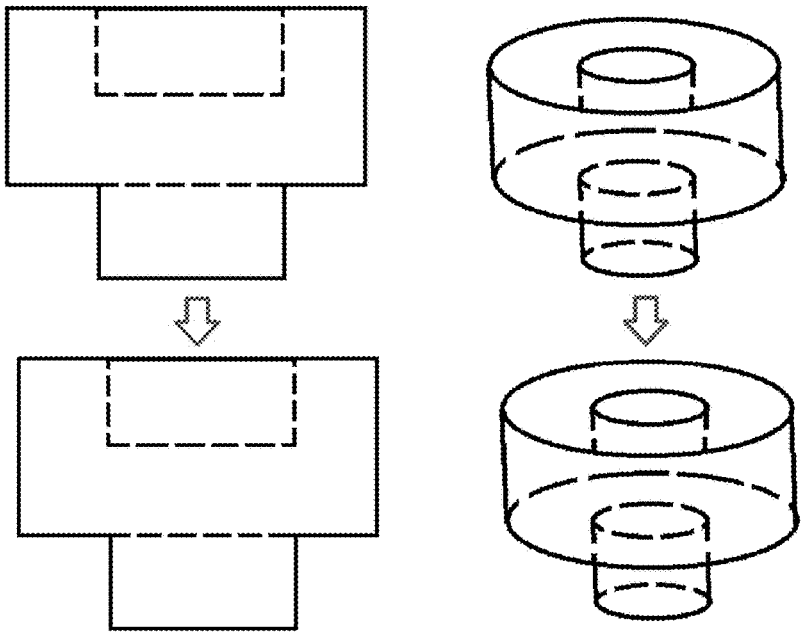
FIG. 31 is a wireframe drawing to illustrate how the discs stack.

FIG. 31 is a wireframe drawing to illustrate how the discs stack.

Figure 32:
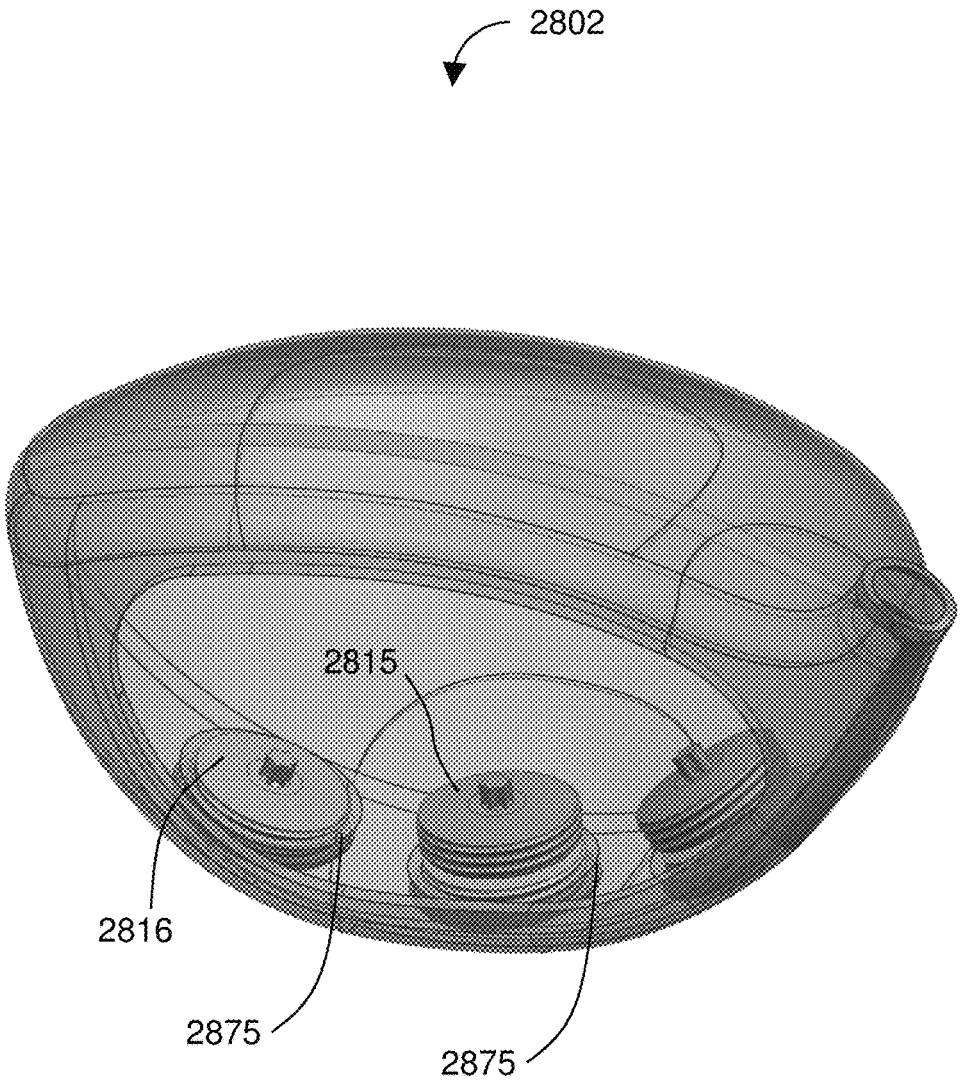
FIG. 32 is a perspective view of the club head showing the three ports with discs.

FIG. 32 is a perspective view of the club head 2802 showing three disc ports 2875 disposed from heel to toe across the sole, each with at least one of the stackable discs threaded therein.

Figure 33:
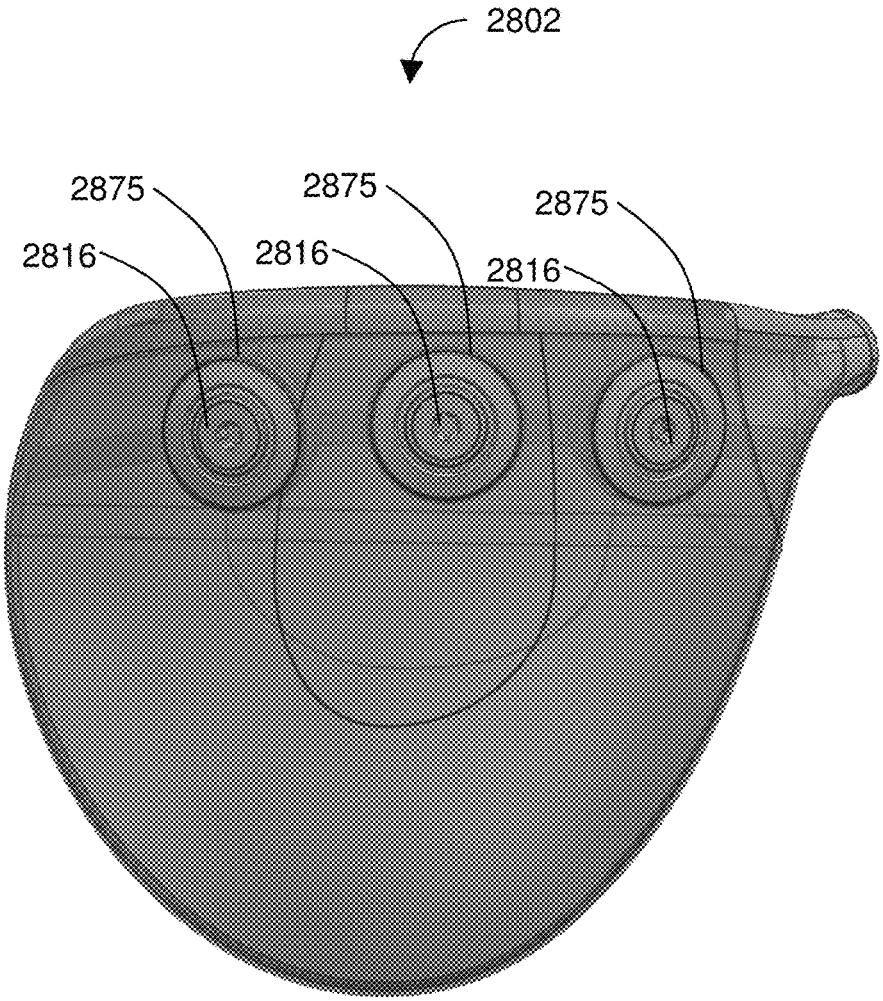
FIG. 33 is a bottom view of the club head with three weight ports on the sole.

FIG. 33 is a bottom view of the club head 2802 showing the disc ports 2875 on the sole. The golf club head 2802 is shown as having three ports 2875 of equal diameter, such that a disc threaded into one of the ports may be removed and moved to another one of the ports. In certain embodiments, the club head includes ports of varying diameters and corresponding discs of varying diameters. For example, the club head may include two large ports (e.g., diameter approximately 2 to 3 cm) and two smaller ports (e.g., diameter about 1 cm or less). One large port and one smaller port may be on a heel-ward portion of the sole and the other large port and the other small port may be on a toe-ward portion of the sole. A golfer may then fine-tune a mass distribution of the club head to correct a hook or slice by choosing to relocated a large or a smaller disc from the corresponding weight port. For example, for a fine tune, the golfer may swap the two smaller discs between the two smaller port. Where the two smaller discs have unlike masses, this will shift the mass-distribution of the club head in a heel/toe direction corresponding to a new location of the smaller disc with greater mass. Where the two larger discs have unlike masses, the golfer can make a larger shift in mass by swapping the two larger discs. Additionally, the smaller and larger discs can be provided with posts and slots so that they are stackable with one another. Thus, a golf club head 2802 with disc ports provides a useful benefit in that mass distribution of the club head can be customized to a golfer.

The use the flanged disc 2816 and any optional stacking disc 2815 with the weight port 2875 as well as any optional well(s) 2881 provides a variety of advantageous and utilitarian benefits. Of primary benefit is that the flanged discs 2816 and the stacking discs 2815 may be stacked together. Because the discs may be stacked together, where different discs have different masses, a greater number of mass distributions can be obtained for the club head for a given number of disc ports than with weights that do not stack. Thus with just the parts shown, for example, in FIG. 32, if the discs are of different masses, dozens of different mass distributions may be obtained via rearrangement. Additionally, since the ports 2875 hold the discs via threaded interior perimeters, no additional mass is required for wells, recesses, mount points, etc., which frees up mass to be used in the discs. That is, because the flanged disc 2816 threads directly to a perimeter of the weight port 2875, there is no need for an assembly or boss to hold the disc in the head. Optionally, any of those discs may be provided as magnetic weights with an electromagnetic tool to disengage the weights. The club head may be provided with a variable diameter of the weight discs. In some embodiments, the discs are provided with translucent or transparent non-metallic material to fill the port 2875. This allows a golfer to see into the club head 2802. An inside surface of the club head 2802 (e.g., an inside surface of the crown 2869) may be printed with diagrams of possible weight combinations of the flanged disc 2816 and any optional stacking disc 2815 and those diagrams may be labelled to indicate a playing property of the club head associated with each weight combination. Because the port 2875 is large enough in diameter, a golfer or pro-shop employee can reach in with a permanent marker and place a check mark by the preferred weight combination for some specific golfer. Additionally or alternatively, one or more of the discs may be or include an electronic device.

FIGS. 34-38 depict an adjustable golf club head 3402 according to certain embodiments.

Figure 34:
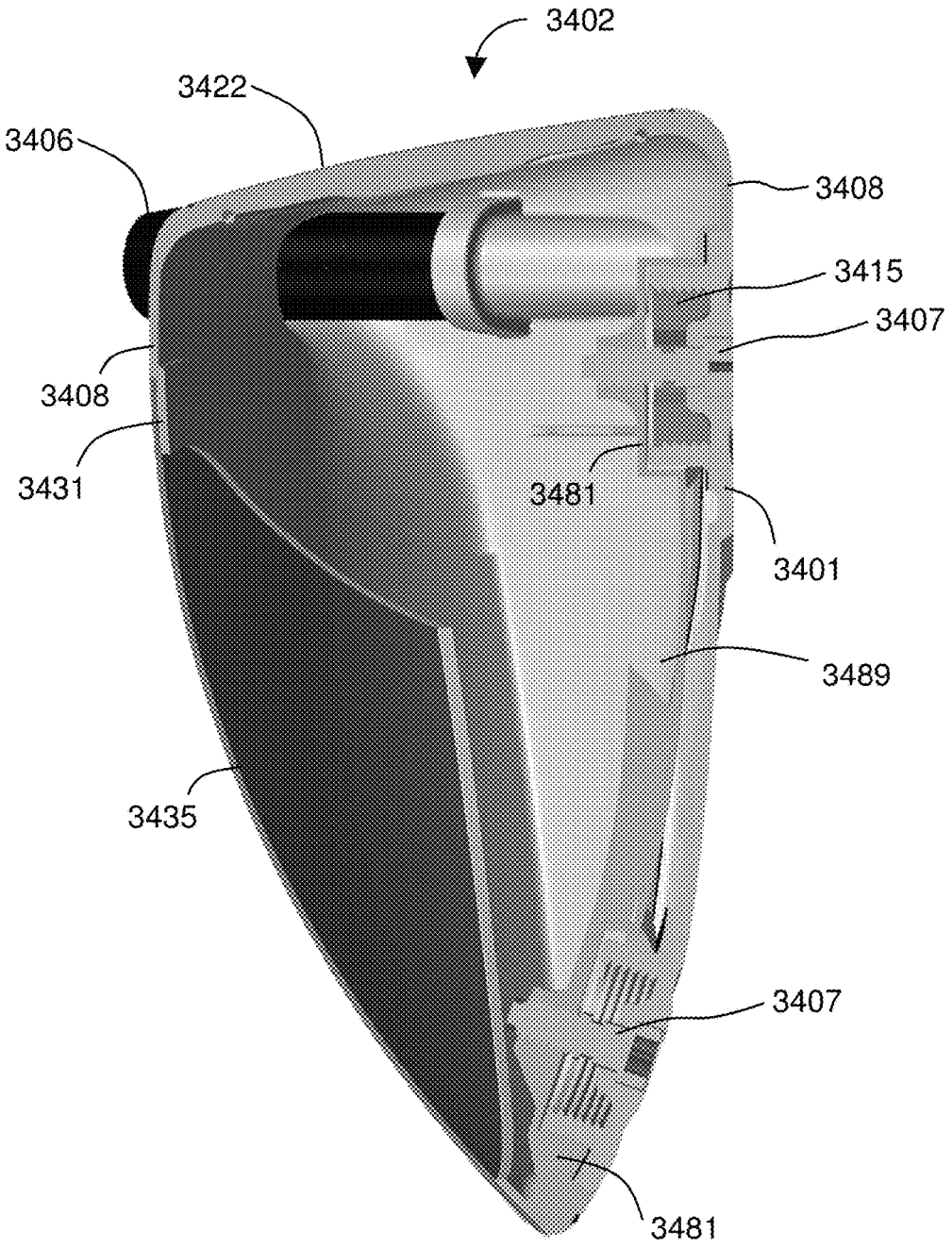
FIG. 34 is a cutaway view of an adjustable golf club head.

FIG. 34 is a cutaway view of an adjustable golf club head 3402 that includes a ball-striking face 3422 at a front portion of the club head 3402 as well as a crown and a sole extending back from the ball striking face 3422. The crown meets the sole at a heel side, a toe side, and an aft portion of the adjustable club head 3402. The ball-striking face 3422, the crown, and the sole define a hollow interior volume of the club head. A hosel 3406 extends up from the heel side of the front portion of the club head. The club head 3402 optionally includes a crown piece 3435 mounted to a club head body 3408.

The club head body 3408 preferably includes a ledge 3431 defining a cutaway void for mounting the crown piece 3435. In certain preferred embodiments, the crown piece 3435 is carbon fiber with about 4 plies of prepreg unidirectional (UD) tape and optionally at least one ply of the carbon fiber yarn-based composite material sold under the trademark TEXTREME by Oxeon AB (Sweden). The club head body 1508 includes two wells 3481 that receive a disc 3415 when the panel 3401 is attached to the club head 3402. When the removable panel 3401 is attached to the club head 3402, the screws 3407 are received by threaded bores in the wells 3481.

Figure 35:
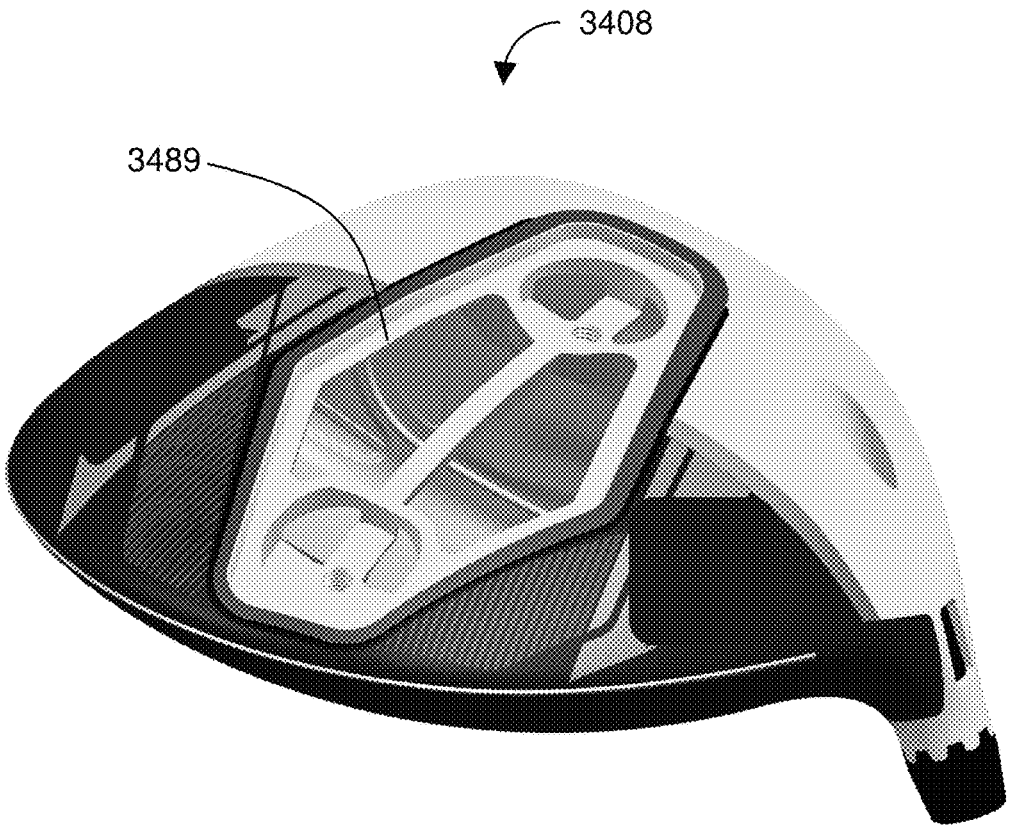
FIG. 35 shows a club head body of the adjustable club head.

FIG. 35 shows the club head body 3408. The club head body 3408 is preferably a titanium casting or similar made piece. The club head body 3408 includes an opening 3489 through the club head. A removable panel 3401 is provided to enclose the opening 3489 through the club head body 3408.

Figure 36:
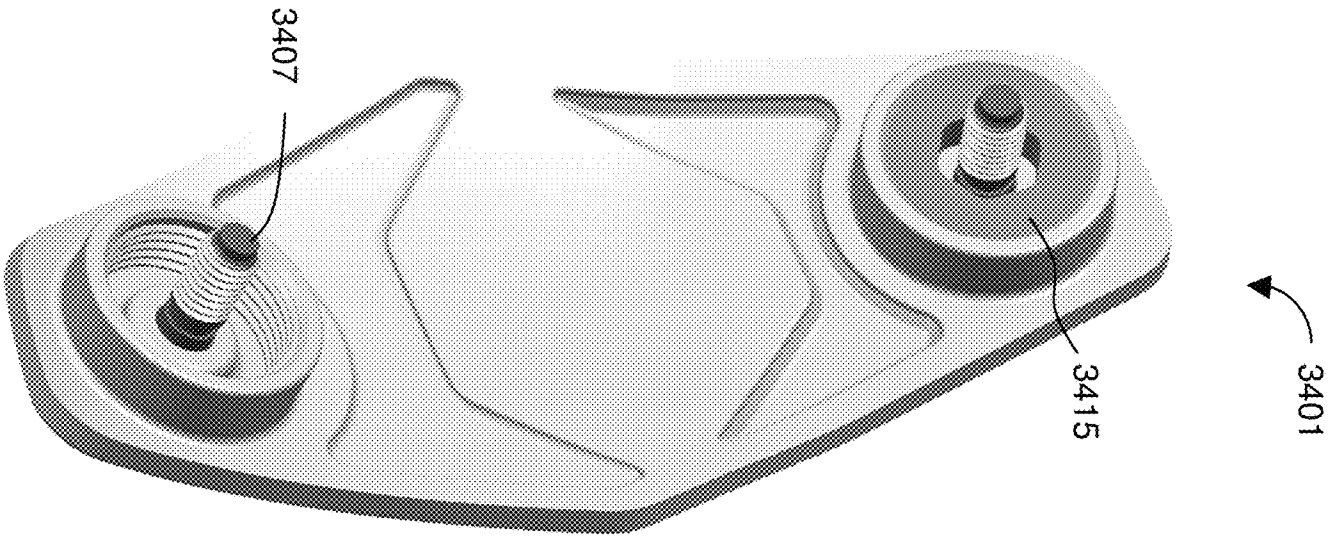
FIG. 36 shows the removable panel for the adjustable club head.

FIG. 36 shows the removable panel 3401, designed to receive one or more discs 3415. The discs 3415 can be removed and switched around to change the mass properties of the head 3402. Once the discs 3415 are on the panel 3401, the panel 3401 is then screwed onto the head 3402. The removable panel 3401 provides internal access. When the removable panel 3401 is removed, access is provided to the internals of the head. The removable panel 3401 is attached to the head 3402 with screws 3407.

Any suitable discs 3415 may be included. In preferred embodiments, the discs provide a set of weights with varying masses and a user can combine the weights in a variety of spatial patterns to tune a center of gravity location of the club head. Additionally or separately, one or more of the discs 3415 may provide other functionality. For example, a disc may include an electronic device. In some embodiments, one or more of the discs include one or more of a battery, an accelerometer, an RFID tag, an antenna, a microchip, memory, an input/output jack (e.g., a mini- or micro-USB port), an electrical contact point or jack, a piezoelectric sensor, clock, GPS sensor, others, or a combination thereof. For example, in one embodiment, the discs are stackable and have exposed electrical contact points. A base disc may include a battery and have copper spring contacts on a top surface. A top disc may include a piezoelectric shock sensor, memory, a chip, and I/O device such as RF antenna or mini-/micro-USB port. When assembled, the battery in the base disc powers the devices in the top disc. The piezoelectric shock sensor generates a signal each time a golfer takes a shot with club head 1502. A record of the shot, optionally with its time, location, or both, is recorded in the memory and the record may be transferred to a device such as a remote computer or smartphone. In the most preferred embodiments, the discs are weights with varying masses and are stackable.

Figure 37A:
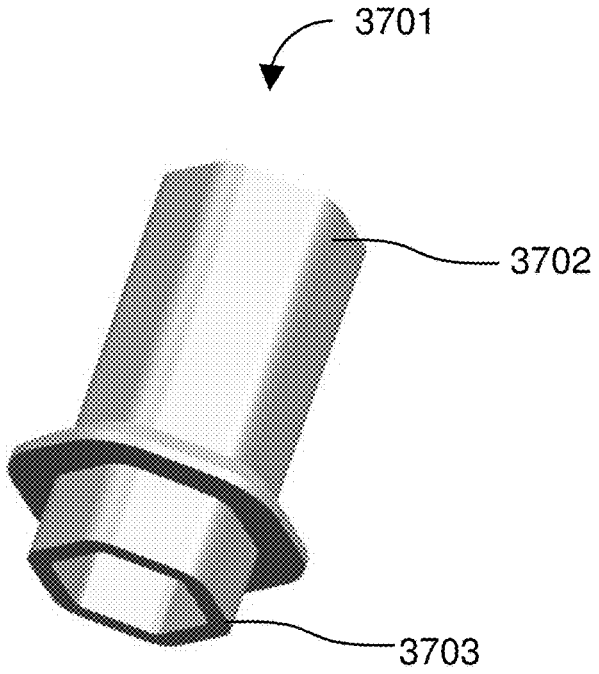
FIG. 37A is a perspective view of a tool adapter.

FIG. 37A is a perspective view of a tool adapter 3701 for use with the disc 3415. The adapter includes a first end 3702 and a second end 3703. The second end 3703 is configured to mate with disc 3415.

Figure 37B:
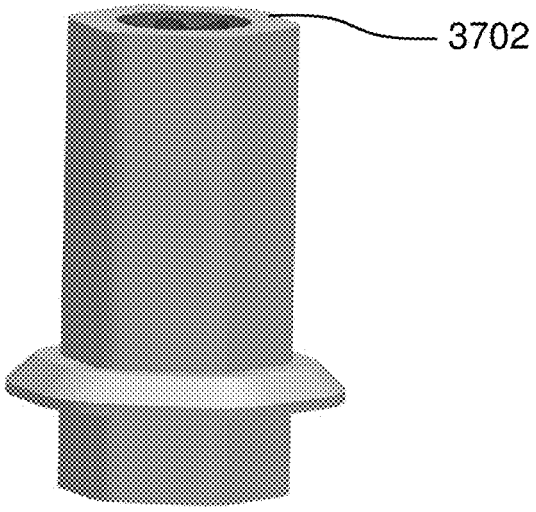
FIG. 37B is another view of the adapter.

FIG. 37B is another view of the adapter 3701, showing that the first end 3702 is configured to receive a specialty tool such as a star-driver wrench such as that sold under the trademark TORX.

Figure 38:
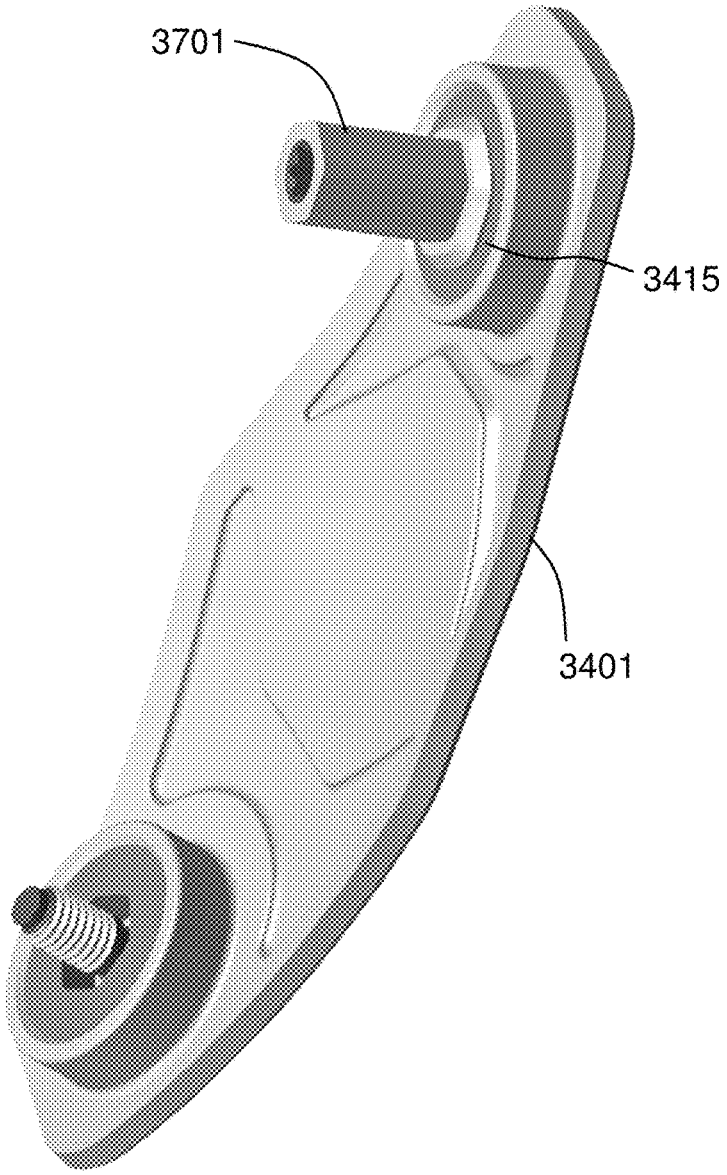
FIG. 38 shows the adapter seated in a disc.

FIG. 38 shows the adapter 3701 seated in the disc 3415 positioned within the removable panel 3401. Using the adapter 3701 and a suitable tool (such as a TORX-style torque wrench), the disc 3415 can be removed and re-seated in either of the positions provided on the panel 3401. In preferred embodiments, the adjustable club head 3702 is provided with two or more of disc 3415 with different masses. A golfer can select the mass arrangement that offers the best characteristics for that golfer. Thus the club head 3402 can be adjusted to accommodate different playing styles.

References to other documents, such as patents, patent publications, and articles, are made in this disclosure. All such documents are incorporated by reference.

Various modifications of the invention and many further embodiments thereof, in addition to those shown and described herein, will become apparent to those skilled in the art from the full contents of this document, including references to the scientific and patent literature cited herein. The disclosure herein contains information, exemplification and guidance that can be adapted to the practice of this invention in its various embodiments and equivalents thereof.

What is claimed is:

1. A golf club head comprising:

a ball-striking face at a front portion of the club head;

a crown and a sole extending back from the ball striking face, the crown meeting the sole at a heel side, a toe side, and an aft portion of the club head, wherein the ball-striking face, the crown, and the sole define a hollow interior volume of the club head;

a hosel extending up from the heel side of the front portion of the club head;

a first disc port through the club head; and a first disc seated in, and enclosing, the port;

wherein the first disc has a post and a slot on opposed surfaces, the post being complementary to the slot so that the first disc may be stacked with a second disc having a second slot shaped similarly to the slot; and wherein the first disc comprises: a main, disc-shaped body with the slot on one surface and the post on a second surface opposed to the surface; a threaded surface about the disc-shaped body; and a flange extending outwards radially past the threaded surface, wherein the flange provides a stopping point when the first disc is screwed into the first port.

2. The golf club head of claim 1, further comprising a first stacking disc stacked on the first disc, wherein the first stacking disc has: a second disc-shaped body with a second slot and a second tool post, and a second threaded surface about the second disc-shaped body.

3. The golf club head of claim 2, further comprising a second disc port and a third disc port, wherein the first disc port, the second disc port, and the third disc port are disposed across the sole in a heel-toe direction, the club head further comprising a second disc threaded into the second disc port and a third disc threaded into the third disc port.

4. The golf club head of claim 3, further comprising a second stacking disc stacked on the second disc, wherein the first stacking disc and the second stacking disc are each configured to be stacked onto any of the other discs and retained there by a post-in-slot press-fit mechanism.

5. The golf club head of claim 3, wherein each of the first disc port, the second disc port, and the third disc port has a diameter of at least about 1 cm such that each of the first disc port, the second disc port, and the third disc port when not filled by a disc provides an opening into the hollow interior volume with an area of at least $\pi(0.5\ \text{cm})^2$.

6. The golf club head of claim 5, further comprising a second stacking disc stacked on the second disc, wherein the second stacking disc has: a third disc-shaped body with a third slot and a third tool post, and a third threaded surface about the third disc-shaped body.

7. The golf club head of claim 6, wherein each of the first disc has a first mass and the second disc has a second mass unlike the first mass, and wherein the first stacking disc has a third mass and the second stacking disc has a fourth mass unlike the third mass.

8. The golf club head of claim 7, wherein fourth mass and the third mass are both unlike the first mass and the second mass.

* * * * *